US009111301B2

(12) United States Patent
McGuire

(10) Patent No.: US 9,111,301 B2
(45) Date of Patent: Aug. 18, 2015

(54) ACTIVATING AN ACCOUNT BASED ON AN SMS MESSAGE

(75) Inventor: Paul Russell McGuire, London (GB)

(73) Assignee: BOKU, INC., San Francisco, CA (US)

( * ) Notice: Subject to any disclaimer, the term of this patent is extended or adjusted under 35 U.S.C. 154(b) by 711 days.

(21) Appl. No.: 13/324,962

(22) Filed: Dec. 13, 2011

(65) Prior Publication Data

US 2013/0151385 A1 Jun. 13, 2013

(51) Int. Cl.
*G06Q 30/04* (2012.01)

(52) U.S. Cl.
CPC ..... *G06Q 30/04* (2013.01)

(58) Field of Classification Search
None
See application file for complete search history.

(56) References Cited

U.S. PATENT DOCUMENTS

| | | | |
|---|---|---|---|
| 6,332,126 | B1 | 12/2001 | Peirce et al. |
| 6,535,855 | B1 | 3/2003 | Cahill et al. |
| 6,685,088 | B1 | 2/2004 | Royer et al. |
| 7,426,492 | B1 | 9/2008 | Bishop et al. |
| 7,562,818 | B1 | 7/2009 | Bierbaum et al. |
| 7,783,532 | B2 | 8/2010 | Hsu et al. |
| 7,913,903 | B1 | 3/2011 | Jones et al. |
| 7,979,308 | B2 | 7/2011 | Ho et al. |
| 8,041,634 | B2 | 10/2011 | Eastley et al. |
| 8,065,185 | B2 | 11/2011 | Foladare et al. |
| 8,132,723 | B2 | 3/2012 | Hogg et al. |
| 8,190,526 | B2 | 5/2012 | Jung et al. |
| 8,245,044 | B2 | 8/2012 | Kang |
| 8,523,069 | B2 * | 9/2013 | Hammad et al. ..... 235/384 |
| 2002/0174063 | A1 | 11/2002 | Major |
| 2003/0028481 | A1 | 2/2003 | Flitcroft et al. |
| 2003/0085272 | A1 | 5/2003 | Andrews et al. |
| 2004/0054625 | A1 | 3/2004 | Kellogg et al. |
| 2004/0117250 | A1 | 6/2004 | Lubow et al. |
| 2004/0128197 | A1 | 7/2004 | Bam et al. |
| 2005/0004839 | A1 | 1/2005 | Bakker et al. |
| 2005/0010472 | A1 | 1/2005 | Quatse et al. |
| 2005/0033675 | A1 | 2/2005 | Nakashima et al. |
| 2005/0086169 | A1 | 4/2005 | Wells et al. |
| 2005/0105735 | A1 | 5/2005 | Iino et al. |
| 2005/0105745 | A1 | 5/2005 | Bowen et al. |
| 2005/0121512 | A1 | 6/2005 | Wankmueller |
| 2005/0187873 | A1 | 8/2005 | Labrou et al. |

(Continued)

OTHER PUBLICATIONS

"International Preliminary Report on Patentability", International PCT Application No. PCT/US12/69176, International Filing Date of Dec. 12, 2012, Dec. 9, 2013.

(Continued)

*Primary Examiner* — Mussa A Shaawat
(74) *Attorney, Agent, or Firm* — Stephen M. De Klerk

(57) ABSTRACT

A plurality of consumer accounts are stored in a data store before being activated by consumers, each having a first pass code and a first PAN or other consumer account identifier. A data exchange module receives an SMS message including a second pass code and extracts a first phone number from the message. A consumer account activation module identifies a selected one of the consumer accounts by matching the second pass code with a selected one of the first pass codes, and stores the first phone number as a second phone number in association in the selected consumer account. A communication and routing module receives a charge request including a second PAN, and identifies a selected one of the consumer accounts by associating one of the first PANs with the second PAN. A transaction processing system then reduces a stored value of the identified consumer account based on the charge.

20 Claims, 14 Drawing Sheets

(56) References Cited

U.S. PATENT DOCUMENTS

| | | | | |
|---|---|---|---|---|
| 2006/0100933 | A1* | 5/2006 | Fujita et al. | 705/26 |
| 2006/0253335 | A1 | 11/2006 | Keena et al. | |
| 2006/0278704 | A1 | 12/2006 | Saunders et al. | |
| 2007/0011252 | A1 | 1/2007 | Taylor | |
| 2007/0067219 | A1 | 3/2007 | Altberg et al. | |
| 2007/0094067 | A1 | 4/2007 | Kumar et al. | |
| 2007/0174124 | A1 | 7/2007 | Zagofsky et al. | |
| 2007/0198432 | A1* | 8/2007 | Pitroda et al. | 705/64 |
| 2007/0255653 | A1 | 11/2007 | Tumminaro et al. | |
| 2008/0010190 | A1 | 1/2008 | Rackley, III et al. | |
| 2008/0010191 | A1 | 1/2008 | Rackley, III et al. | |
| 2008/0097851 | A1 | 4/2008 | Bemmel et al. | |
| 2008/0116264 | A1* | 5/2008 | Hammad et al. | 235/382 |
| 2008/0135612 | A1 | 6/2008 | Silbernagl et al. | |
| 2008/0139171 | A1 | 6/2008 | Bernath | |
| 2008/0156873 | A1* | 7/2008 | Wilhelm et al. | 235/384 |
| 2008/0179394 | A1 | 7/2008 | Dixon et al. | |
| 2008/0189210 | A1 | 8/2008 | Sawhney | |
| 2008/0201212 | A1* | 8/2008 | Hammad et al. | 705/13 |
| 2008/0201226 | A1 | 8/2008 | Carlson et al. | |
| 2008/0203151 | A1* | 8/2008 | Dixon et al. | 235/380 |
| 2008/0203152 | A1* | 8/2008 | Hammad et al. | 235/380 |
| 2008/0203170 | A1* | 8/2008 | Hammad et al. | 235/492 |
| 2008/0208681 | A1* | 8/2008 | Hammad et al. | 705/13 |
| 2008/0208762 | A1 | 8/2008 | Arthur et al. | |
| 2008/0288351 | A1 | 11/2008 | Leung et al. | |
| 2009/0030787 | A1 | 1/2009 | Pon et al. | |
| 2009/0070205 | A1 | 3/2009 | Altberg et al. | |
| 2009/0099965 | A1 | 4/2009 | Grant, IV | |
| 2009/0104888 | A1 | 4/2009 | Cox | |
| 2009/0138302 | A1 | 5/2009 | Breznik et al. | |
| 2009/0147778 | A1 | 6/2009 | Wanless et al. | |
| 2010/0036770 | A1 | 2/2010 | Fourez et al. | |
| 2010/0106592 | A1 | 4/2010 | Brown | |
| 2010/0161433 | A1 | 6/2010 | White | |
| 2010/0185546 | A1 | 7/2010 | Pollard | |
| 2010/0191646 | A1 | 7/2010 | Smith | |
| 2010/0211445 | A1 | 8/2010 | Bodington | |
| 2010/0250359 | A1 | 9/2010 | Gillenson et al. | |
| 2010/0312617 | A1 | 12/2010 | Cowen | |
| 2010/0312678 | A1 | 12/2010 | Davis | |
| 2010/0312703 | A1 | 12/2010 | Kulpati et al. | |
| 2011/0022475 | A1 | 1/2011 | Inbar et al. | |
| 2011/0035302 | A1 | 2/2011 | Martell et al. | |
| 2011/0035791 | A1* | 2/2011 | Prigent et al. | 726/6 |
| 2011/0045896 | A1 | 2/2011 | Sak et al. | |
| 2011/0047045 | A1 | 2/2011 | Brody et al. | |
| 2011/0093327 | A1 | 4/2011 | Fordyce, III et al. | |
| 2011/0137740 | A1 | 6/2011 | Bhattacharya et al. | |
| 2011/0137797 | A1 | 6/2011 | Stals et al. | |
| 2011/0161142 | A1 | 6/2011 | Dunn et al. | |
| 2011/0191231 | A1* | 8/2011 | Zuver, Jr. | 705/37 |
| 2011/0217994 | A1 | 9/2011 | Hirson et al. | |
| 2011/0237232 | A1* | 9/2011 | Hirson et al. | 455/414.3 |
| 2011/0238539 | A1 | 9/2011 | Phillips et al. | |
| 2011/0251892 | A1 | 10/2011 | Laracey | |
| 2011/0270813 | A1 | 11/2011 | Cok et al. | |
| 2011/0289001 | A1 | 11/2011 | Bishop et al. | |
| 2011/0295750 | A1 | 12/2011 | Rammal | |
| 2012/0166311 | A1 | 6/2012 | Dwight et al. | |
| 2012/0173413 | A1 | 7/2012 | Yoo | |
| 2012/0215609 | A1 | 8/2012 | Yoo | |
| 2012/0215619 | A1 | 8/2012 | Yoo | |
| 2012/0259686 | A1 | 10/2012 | Yurow | |
| 2012/0329433 | A1* | 12/2012 | Fogarty | 455/414.1 |
| 2013/0006742 | A1 | 1/2013 | Richard | |
| 2013/0018793 | A1 | 1/2013 | Wong et al. | |
| 2013/0041734 | A1 | 2/2013 | Dean et al. | |
| 2013/0054336 | A1 | 2/2013 | Graylin | |
| 2013/0066689 | A1 | 3/2013 | Dixon | |
| 2013/0325566 | A1* | 12/2013 | Silbernagl | 705/13 |
| 2014/0129356 | A1 | 5/2014 | Jain et al. | |
| 2014/0180776 | A1* | 6/2014 | Silbernagl | 705/13 |

OTHER PUBLICATIONS

"Written Opinion of the International Preliminary Examining Authority", International Application No. PCT/US12/67390, International Filing Date Nov. 30, 2012, Nov. 8, 2013.

Cook, Alyson, "Retail vouchers A-Z", Incentive Business, Oct. 2003.

Singer, Steve, "Vouchers: More data, fewer dollars", Pharmaceutical Executive, Nov. 2001.

International Application No. PCT/US2012/024912, International Filing Date: Feb. 13, 2012, International Search Report and Written Opinion mailed on Jun. 8, 2012.

International Application No. PCT/US11/66824, International Filing Date: Dec. 22, 2011, International Search Report and Written Opinion, mailed on Apr. 19, 2012.

International PCT Application No. PCT/US12/24912, filed on Feb. 13, 2012, International Preliminary Report on Patentability, May 13, 2013.

International Search Report and Written Opinion, International PCT Application No. PCT/US13/32861, International Filing Date of Mar. 18, 2013, mailing date May 31, 2013.

"International Preliminary Report on Patentability", International PCT Application No. PCT/US12/68705, Int'l Filing Date Dec. 10, 2012, Jan. 29, 2014.

"International Preliminary Report on Patentability mailed on Apr. 1, 2014", International Patent Application No. PCT/US13/27742, filed of Feb. 26, 2013, (22 pages).

Chandranmenon, G. P. , "Reducing internet latency using precomputed hints", (Order No. 9945247, Washington University). ProQuest Dissertations and Theses, Retrieved from http://search.proquest.com/docview/304533360?accountid=14753. (304533360), 1999, 189-189p.

McLaughlin, M. L. , "Achieving a multidatabase object transaction service through an asynchronous socket", (Order No. 9953695, Colorado Technical University). ProQuest Dissertations and Theses, Retrieved from http://search.proquest.com/docview/304580173?accountid=14753. (304580173), 1999, 203-203p.

Phillips, D. J. , "Digital cash and the surveillance society: Negotiating identification in new consumer payment systems.", (Order No. 9829972, University of Pennsylvania). ProQuest Dissertations and Theses, Retrieved from http://search.proquest.com/docview/304453540?accountid=14753. (304453540), 1998, 289-289 p.

International Preliminary Report on Patentability, International Application No. PCT/US11/66824, filed on Dec. 22, 2011, Mar. 8, 2013.

International Preliminary Report on Patentability, International Application No. PCT/US2012/024911 filed on Feb. 13, 2012, Mar. 8, 2013.

International Search Report and Written Opinion, International Patent Application No. PCT/US2012/068705 filed on Dec. 10, 2012, 7 pages.

International Search Report and Written Opinion, International Application No. PCT/US2012/069176, filed Dec. 12, 2012, Feb. 20, 2013.

International Search Report and Written Opinion mailed on Feb. 19, 2013, International Application No. PCT/US12/67390 filed on Nov. 30, 2012.

McKitterick, ""A Web Services Framework for Mobile Payment Services." [online]", Published Sep. 2003. [retrieved on Jan. 28, 2013] Retrieved from the Internet BURL: https://www.cs.tcd.ie/publications/tech-reports/reports.03/TCD-CS-2003-59.pdf>, entire document, especially Abstract; sections 3.4.2-3.4.3, 5.3.1-5.3.3, 5.4.1, Sep. 2003.

* cited by examiner

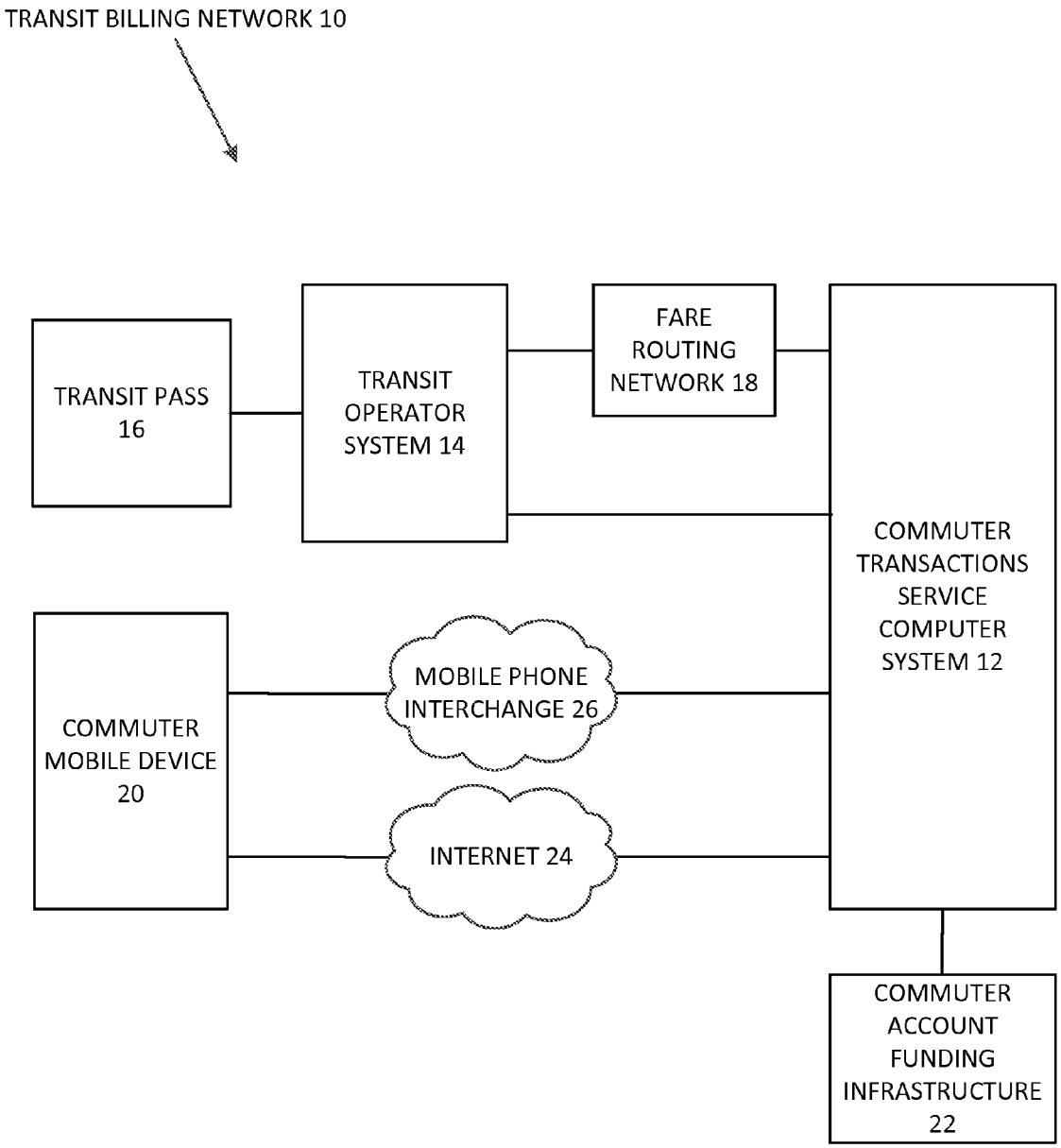
-FIG 1-

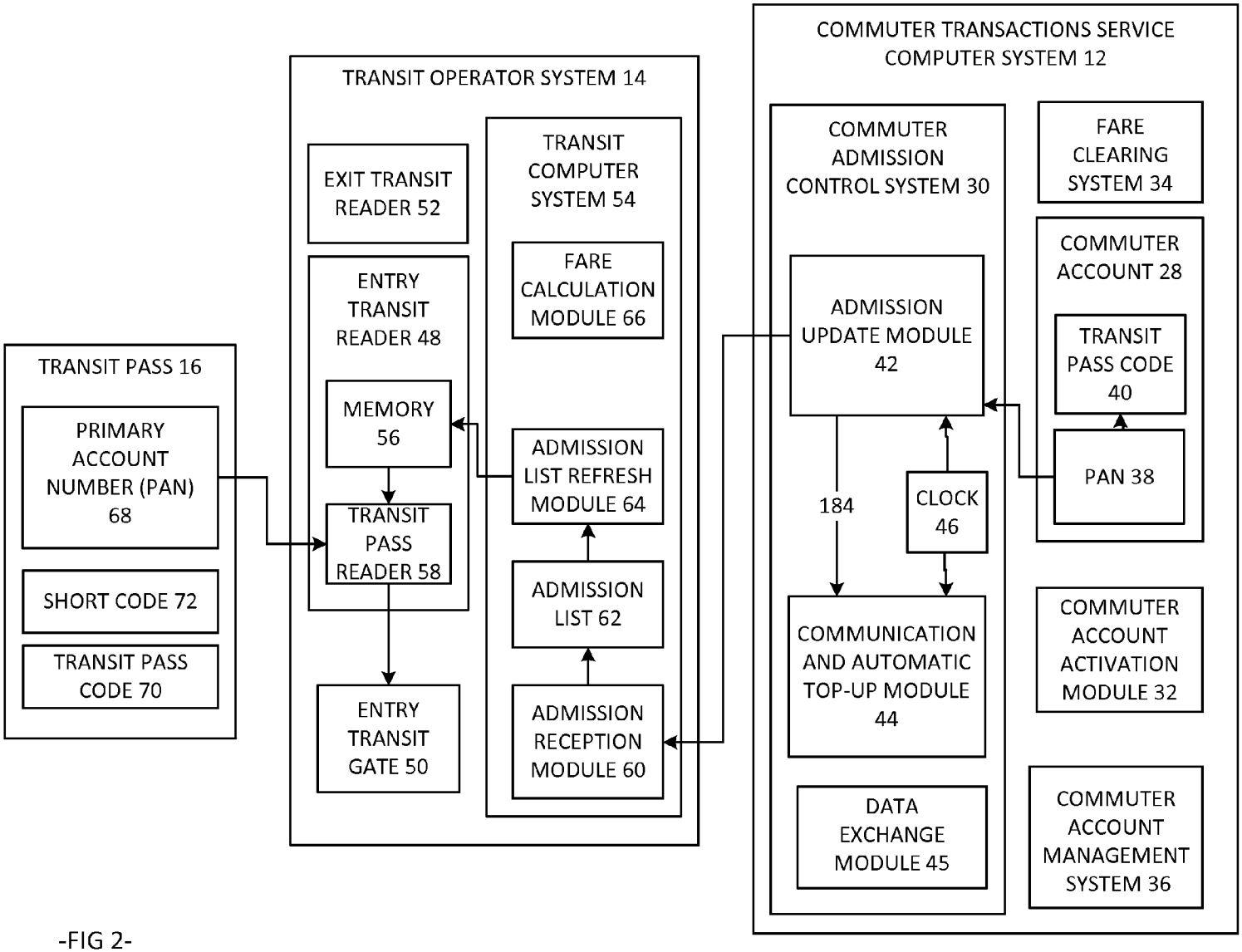
-FIG 2-

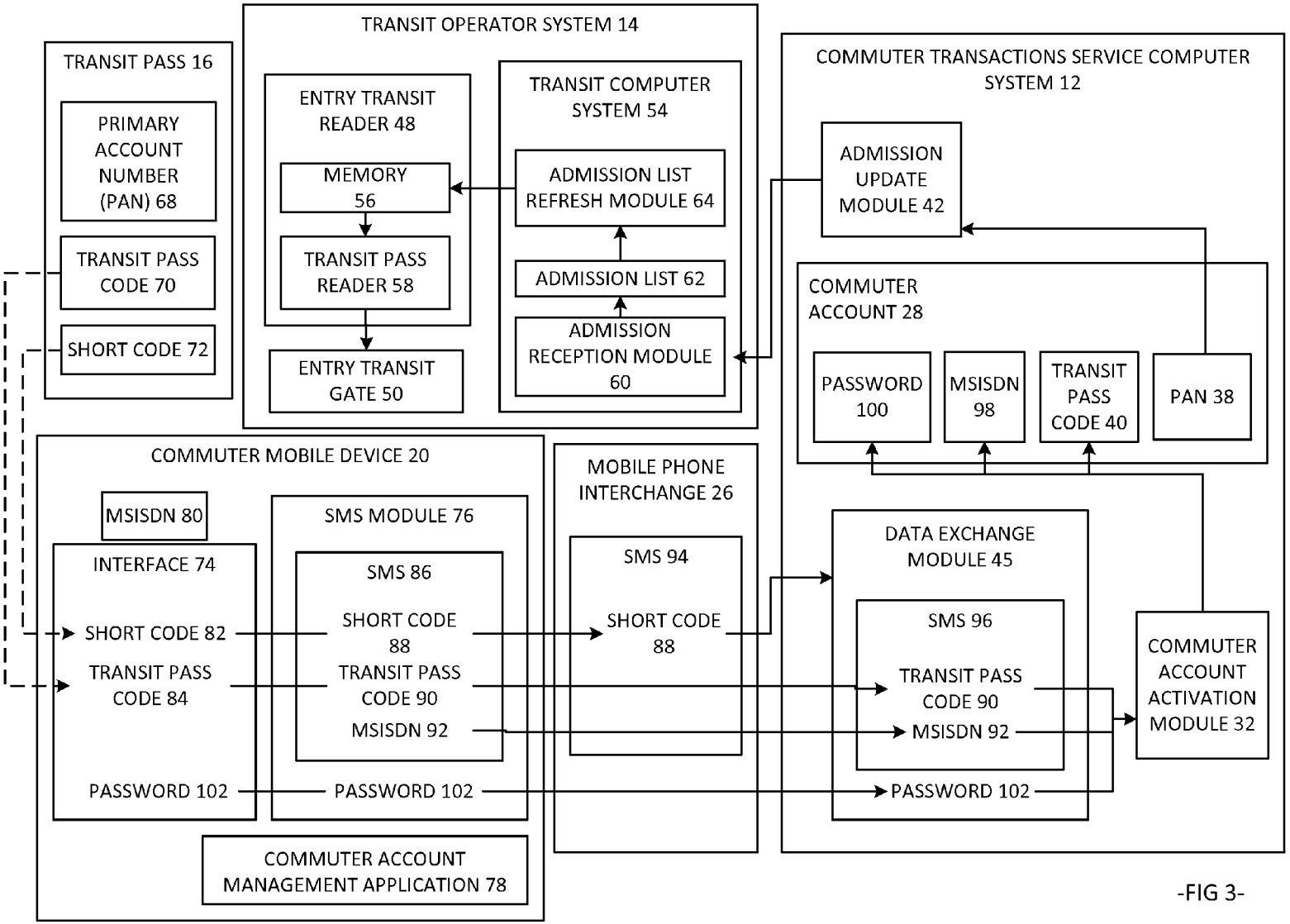
-FIG 3-

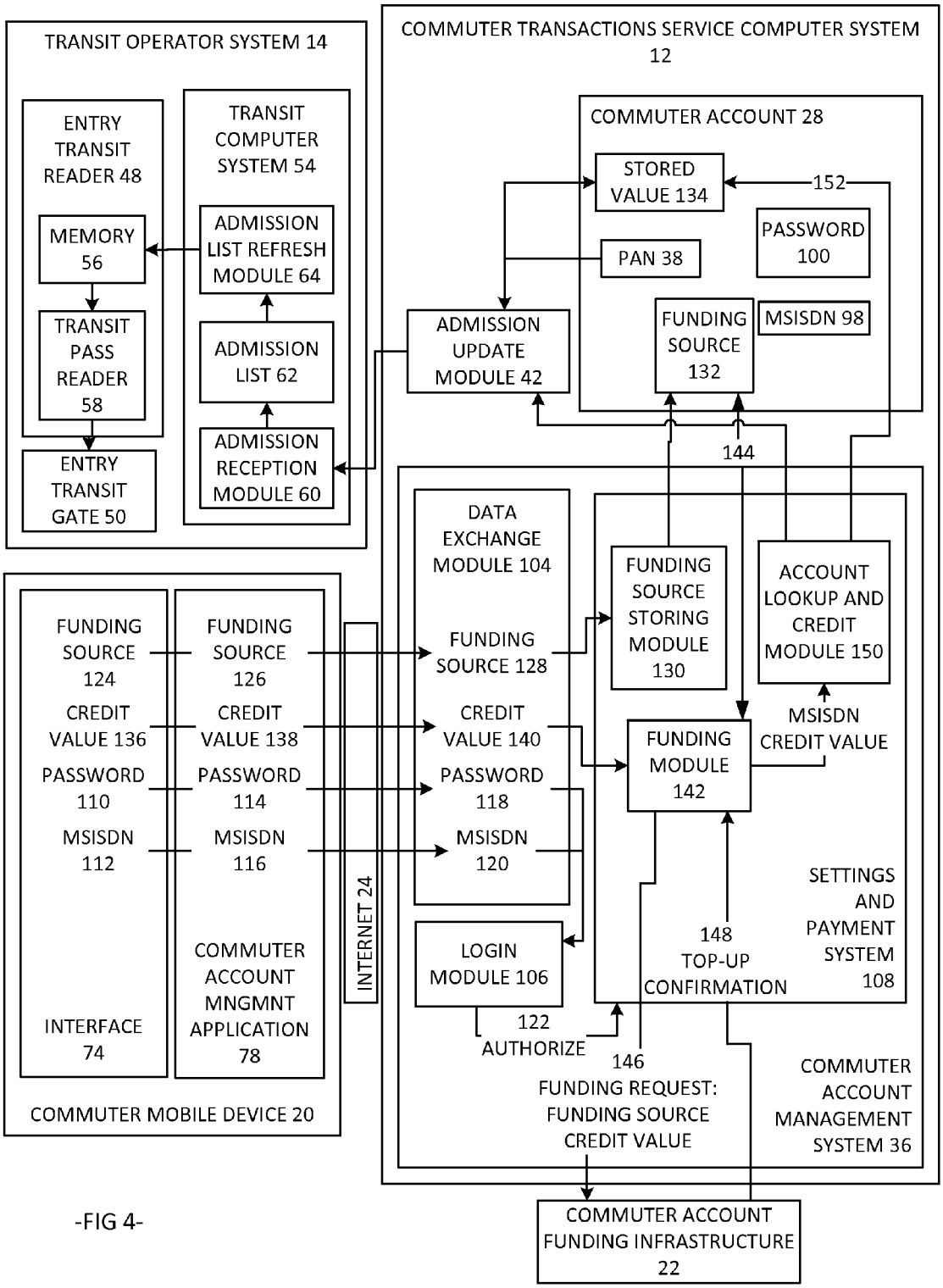
-FIG 4-

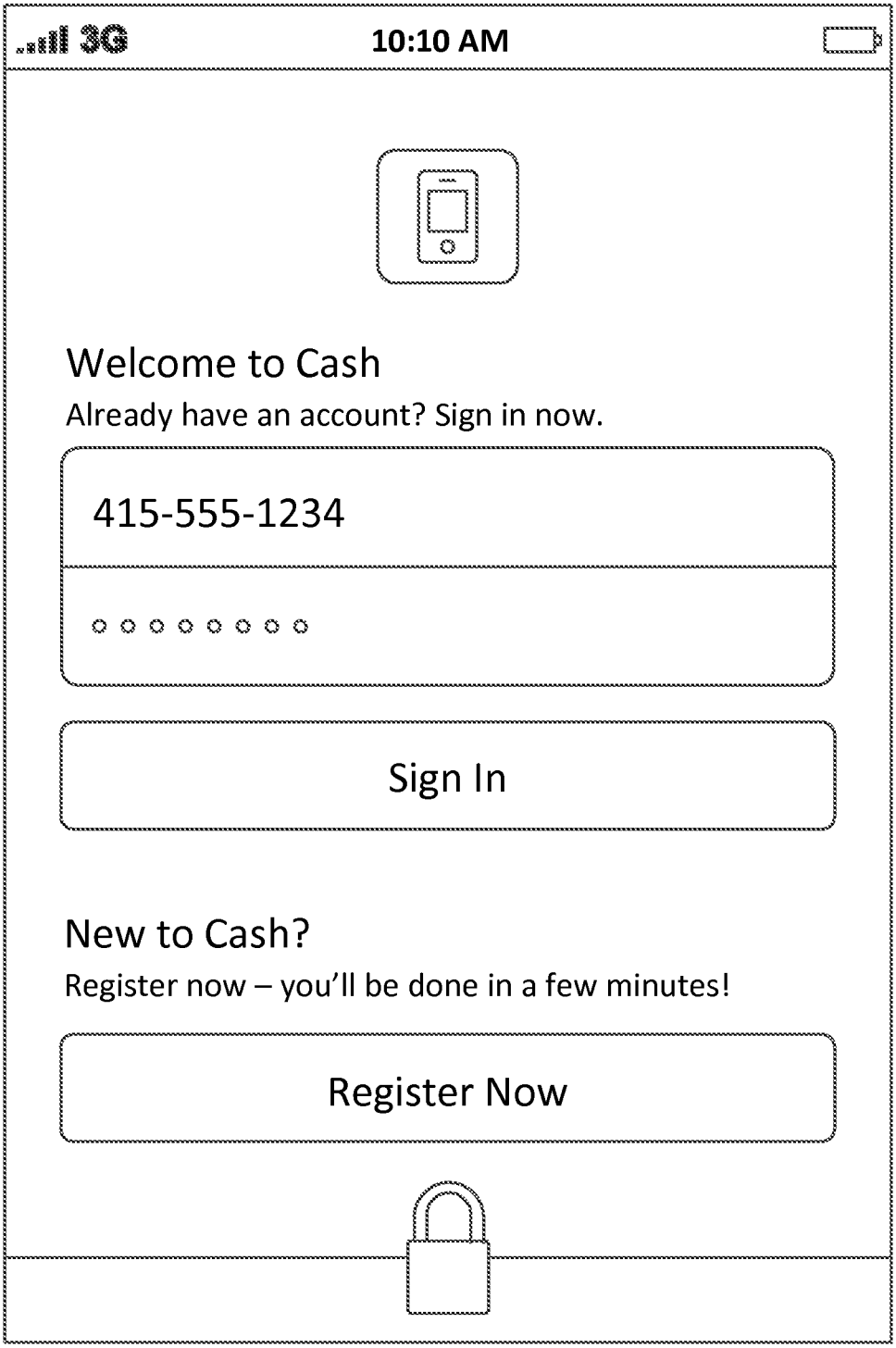
-FIG 5A-

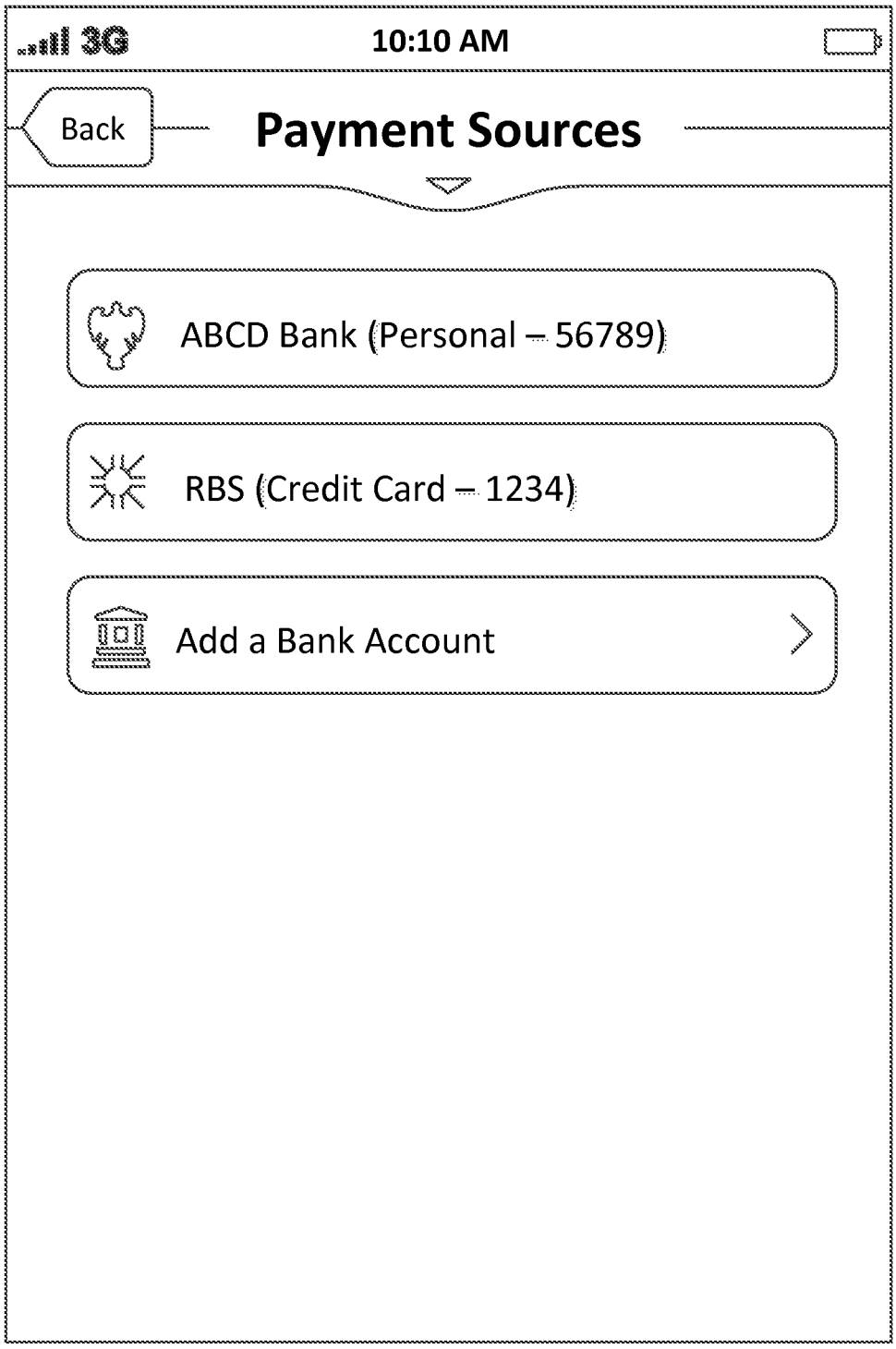
-FIG 5B-

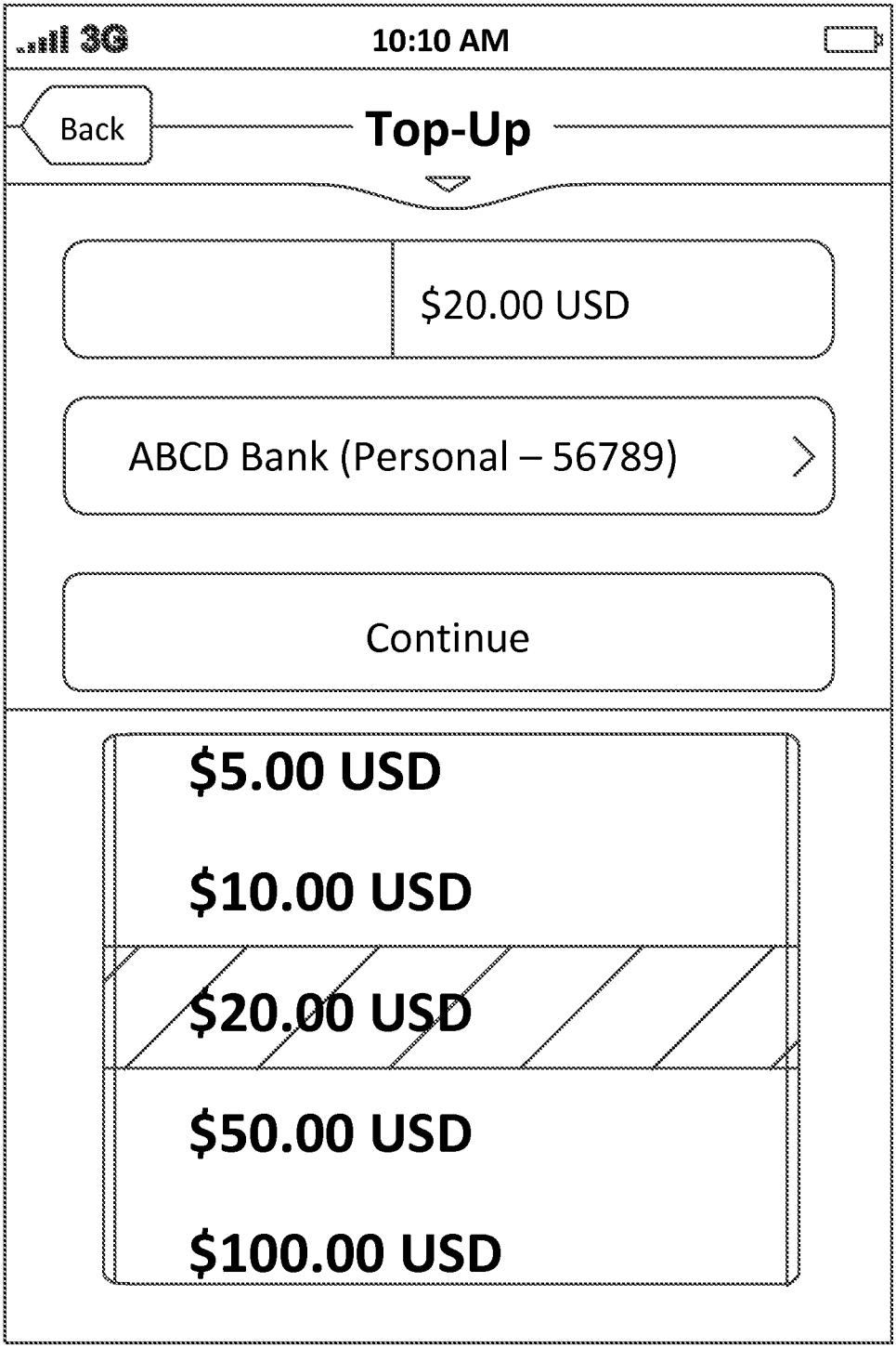
-FIG 5C-

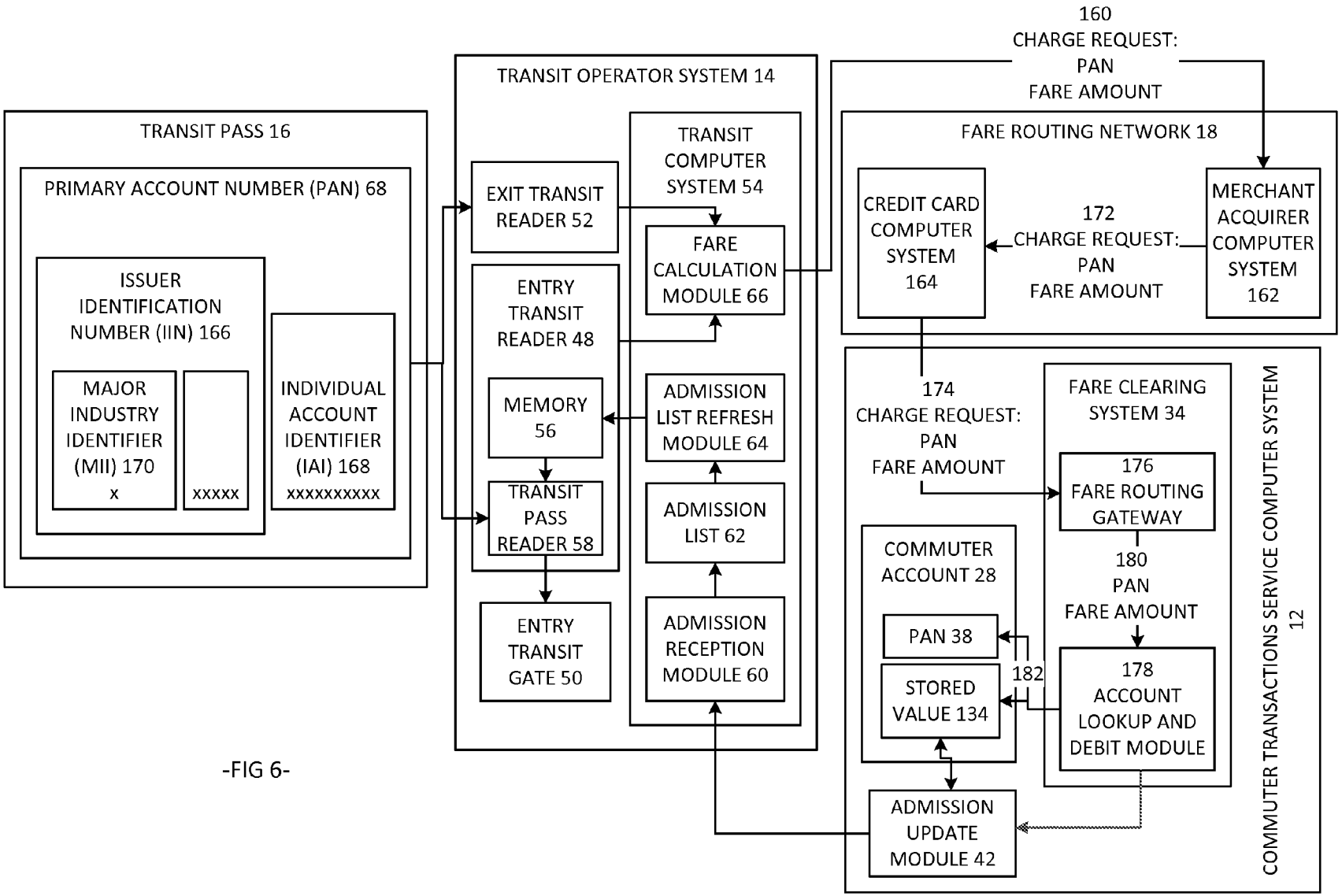
-FIG 6-

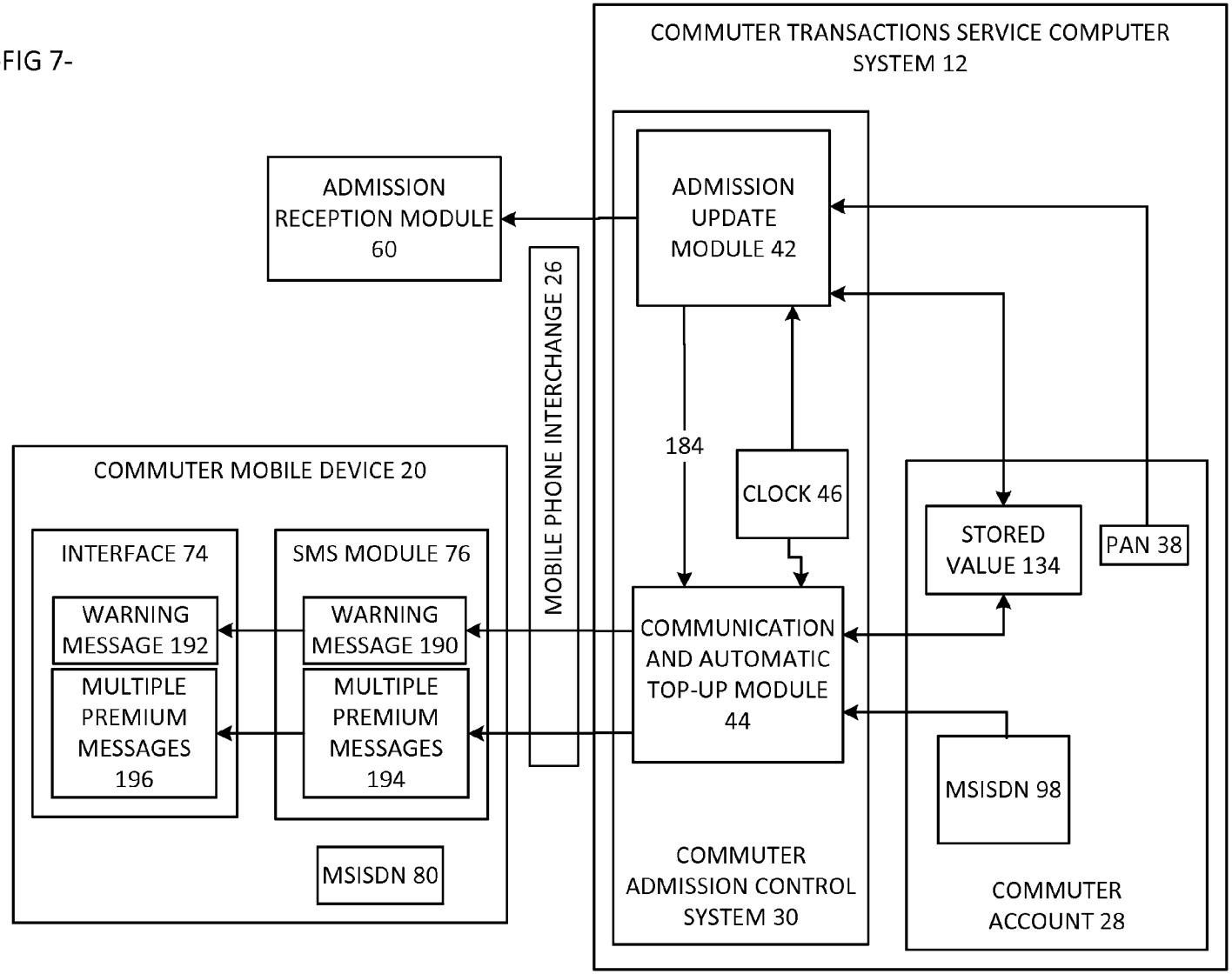
-FIG 7-

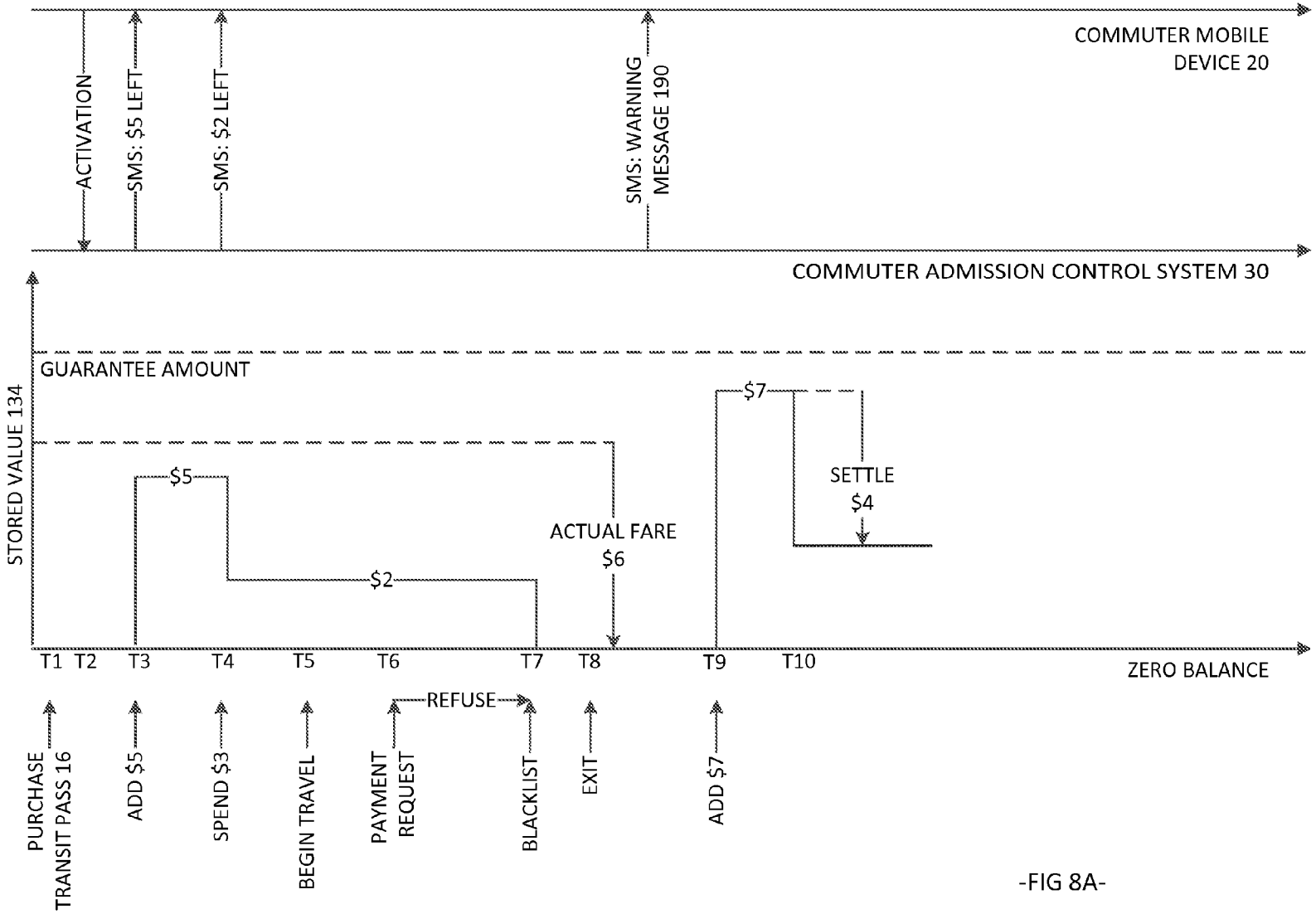
-FIG 8A-

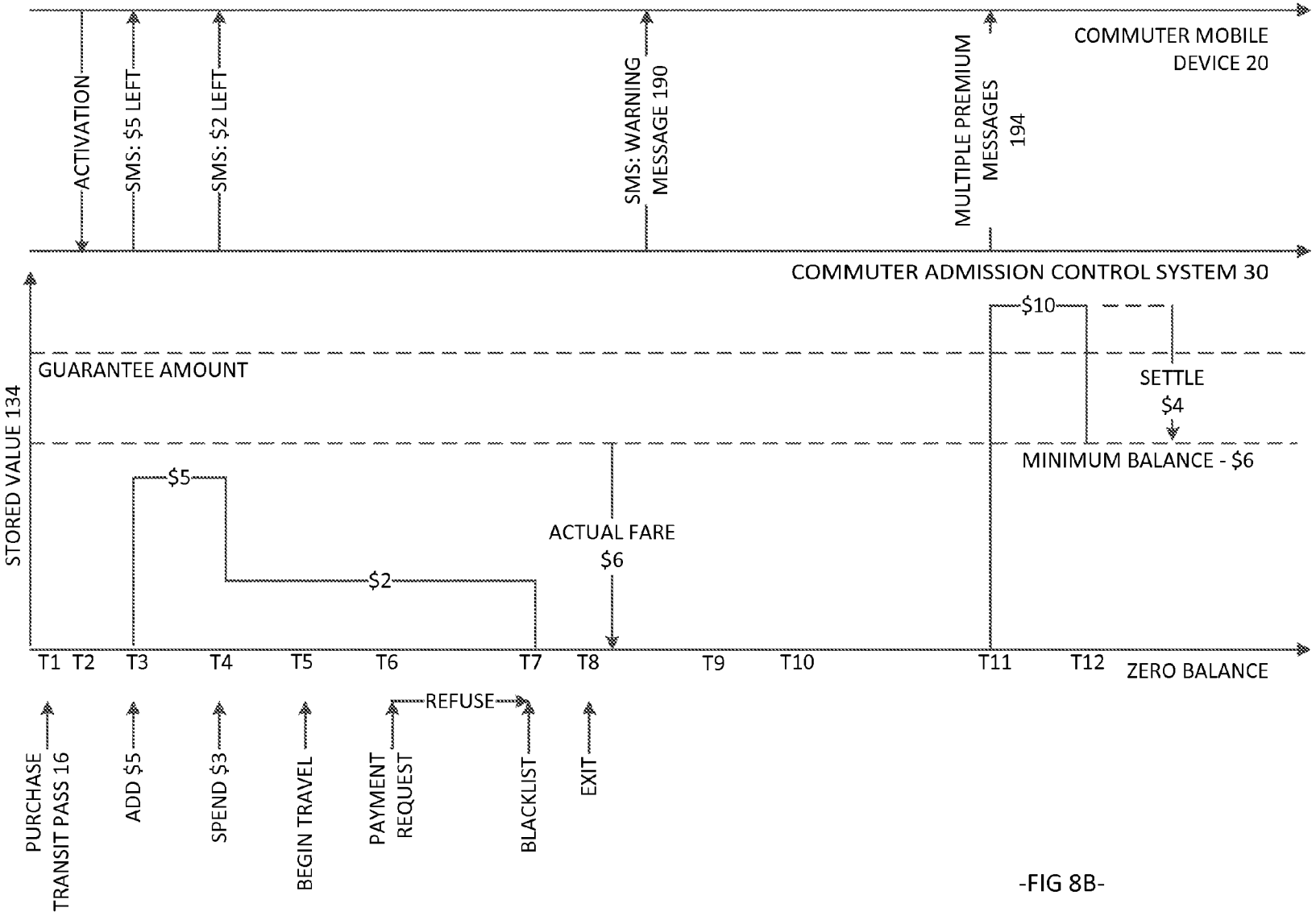
-FIG 8B-

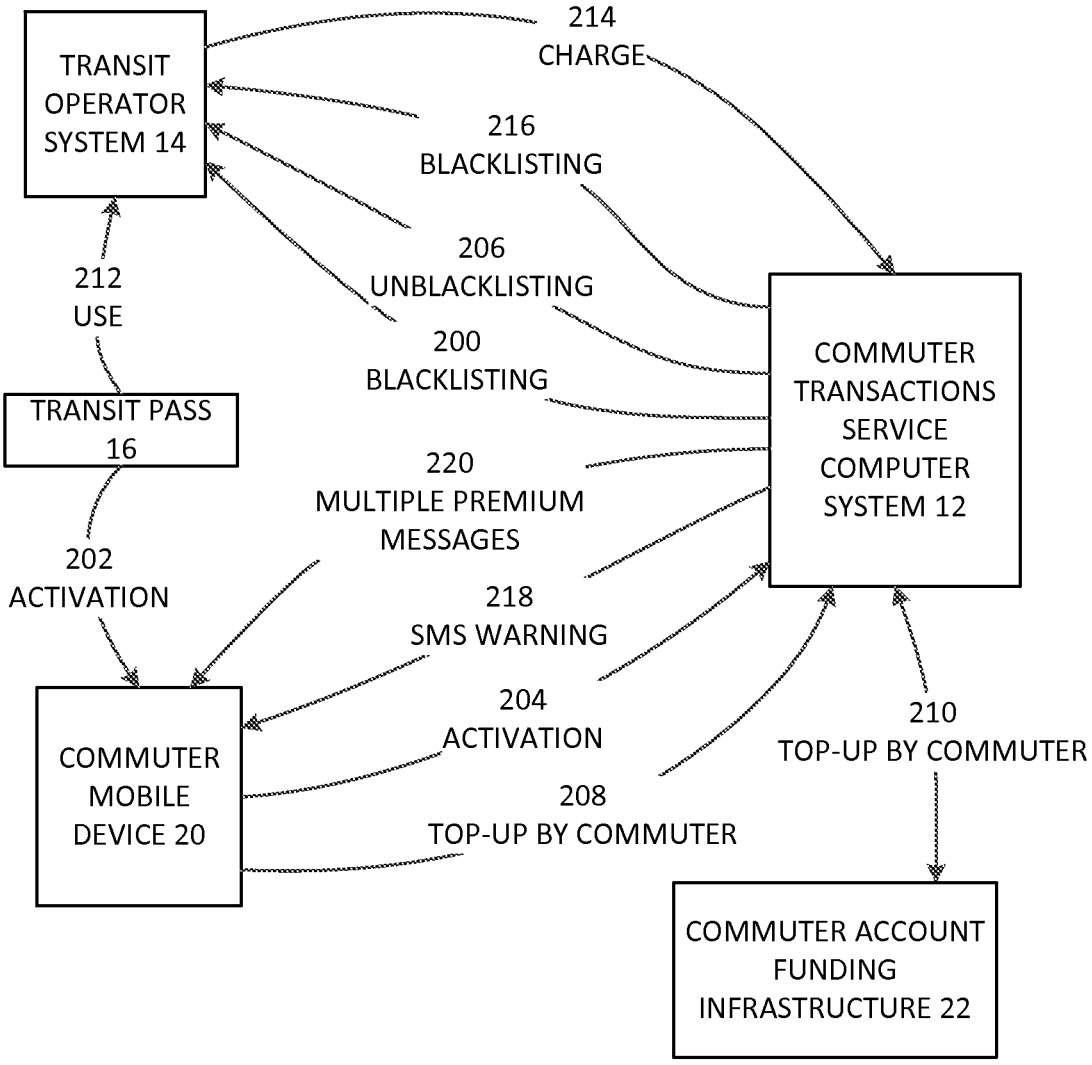
-FIG 9-

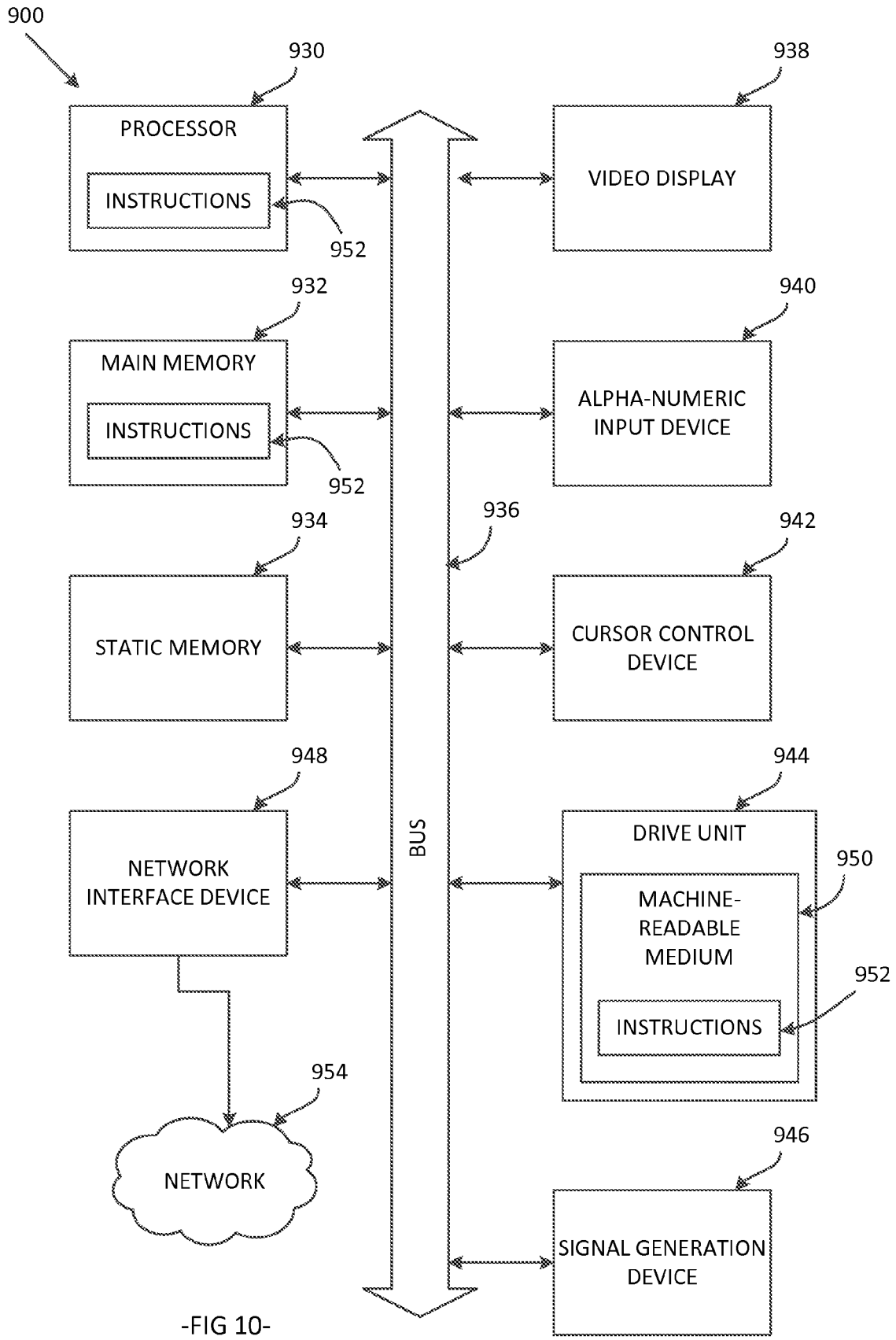
-FIG 10-

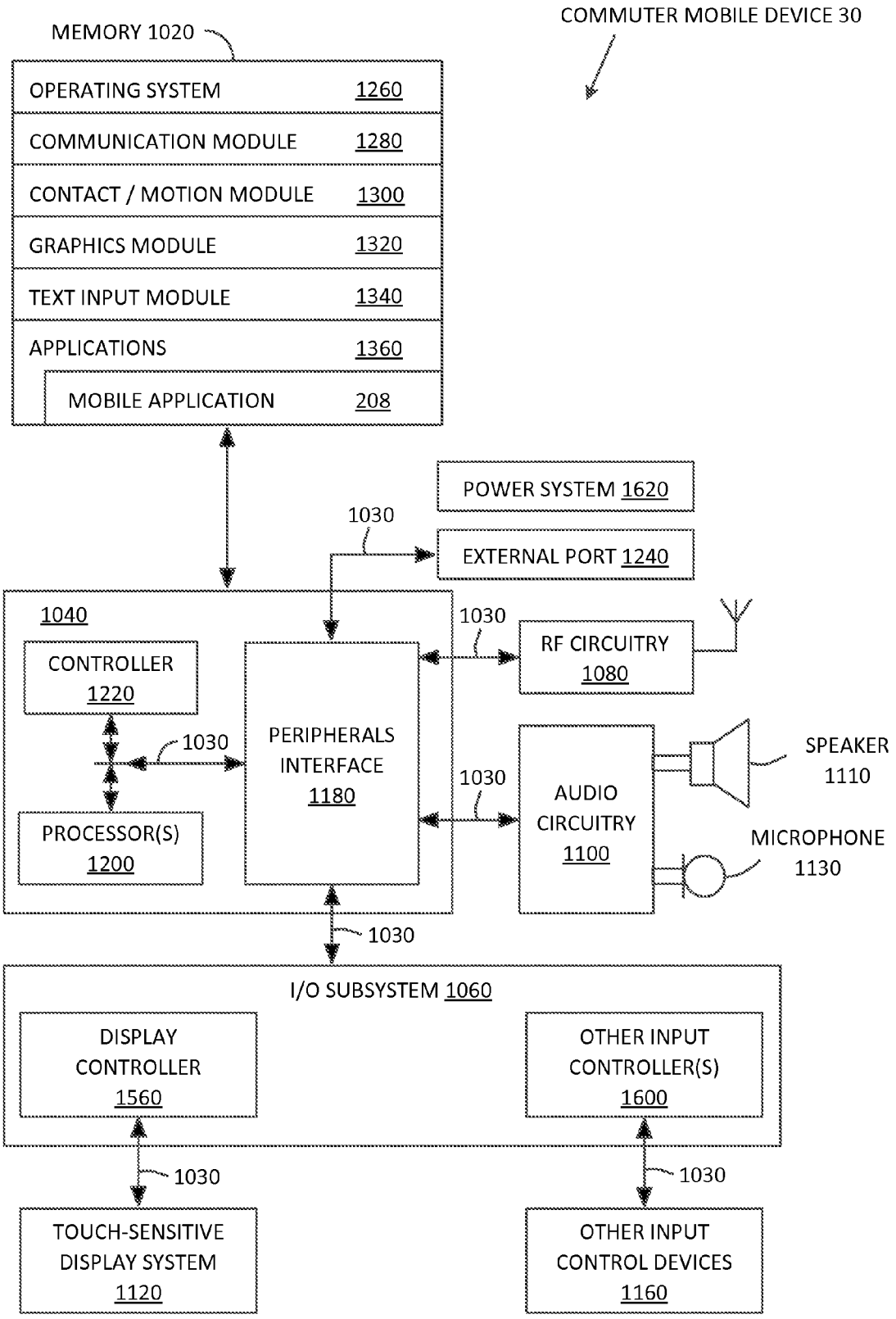
-FIG 11-

ACTIVATING AN ACCOUNT BASED ON AN SMS MESSAGE

BACKGROUND OF THE INVENTION

1). Field of the Invention

This invention relates to a billing network of the kind that can be used as a transit billing network, activation of an account thereof, and control over its use in a time-critical environment.

2). Discussion of Related Art

A transit operator system such as an underground rail network usually has a number of entry transit readers and often a number of exit transit readers that can read transit passes held by commuters. A transit pass may for example have a magnetic strip with a ticket ID thereon, in which case a transit reader has a magnetic strip reader that can read the ticket ID on the magnetic strip. Alternatively, a computer chip on the transit pass may be programmed with a balance that can be read by the entry transit reader. Should the balance be more than a predetermined minimum, the entry transit reader will permit access for the commuter through an entry transit gate. When the commuter exits through the exit transit reader, a table is used to calculate the fare based on a distance travelled and the fare is decremented from the balance on the magnetic strip or on the computer chip.

A transit pass may for example be purchased for an amount that corresponds to an initial amount stored on the chip. When the amount on the chip is depleted, the commuter will either discard the transit pass and purchase a new transit pass, or replenish the amount on the chip in exchange for payment. The repeated issuance of transit passes or replenishment of the amounts thereon results in a large administrative burden on an operator of a transit operator system.

SUMMARY OF THE INVENTION

The invention provides a computer system for managing electronic transactions, including a server computer system including a processor, a computer-readable medium connected to the processor, a network interface device connected to the processor and a set of instructions on the computer-readable medium, the set of instructions being executable by the processor and further including a data store, a plurality of consumer accounts stored in the data store, each consumer account having a first pass code, a data exchange module receiving a message including a second pass code and a first phone number, a consumer account activation module identifying a selected one of the consumer accounts by matching the second pass code with a selected one of the first pass codes and storing the first phone number as a second phone number in association with the selected first pass code of the selected consumer account, a communication and routing module that receives a charge request over the network interface device, the charge request including an amount and a transaction processing system that processes the charge request based on an account detail of the selected consumer account.

The invention also provides a computer system for managing electronic transactions, including a server computer system including a processor, a computer-readable medium connected to the processor, a network interface device connected to the processor; and a set of instructions on the computer-readable medium, the set of instructions being executable by the processor and further including a data store, a plurality of consumer accounts stored in the data store, each consumer account having a first pass code and a respective first consumer account identifier, a data exchange module receiving a message including a second pass code and a first phone number, a consumer account activation module identifying a selected one of the consumer accounts by matching the second pass code with a selected one of the first pass codes and storing the first phone number as a second phone number in association with the selected first account identifier of the selected consumer account, a stored value in the consumer account, a funding module receiving a top-up instruction from a consumer account funding infrastructure, and increasing the stored value based on the top-up instruction, a communication and routing module that receives a charge request over the network interface device, the charge request including an amount and a second consumer account identifier, and identifying a selected one of the consumer accounts by associating one of the first consumer account identifiers with the second consumer account identifier and a transaction processing system that reduces the stored value of the identified consumer account based on the charge.

The invention further provides a computer-based method of managing electronic transactions, including storing, with a processor, a plurality of consumer accounts in a data store, each consumer account having a first pass code, receiving, with the processor, a message including a second pass code and a first phone number, identifying, with the processor, a selected one of the consumer accounts by matching the second pass code with a selected one of the first pass codes, storing, with the processor, the first phone number as a second phone number in association with the selected first pass code of the selected consumer account, receiving, with the processor, a charge request over the network interface device, the charge request including an amount and a second consumer account identifier and processing, with the processor, the charge request based on an account detail of the selected consumer account.

BRIEF DESCRIPTION OF THE DRAWINGS

The invention is further described by way of example with reference to the accompanying drawings, wherein:

FIG. 1 is a block diagram of transit billing network according to an embodiment of the invention;

FIG. 2 is a block diagram of a commuter transactions service computer system, a transit operator system and a transit pass forming part of the transit billing network illustrating blacklisting of all commuter accounts at an entry transit reader of the transit operator system;

FIG. 3 is a block diagram illustrating the components of FIG. 2, and further illustrating a commuter mobile device that is used to activate one of the commuter accounts over a mobile phone interchange;

FIG. 4 is a block diagram illustrating interaction between a commuter account management application on the commuter mobile device and a commuter account management system on the commuter transactions service computer system for purposes of storing a funding source and increasing a stored value in the commuter account, with subsequent unblacklisting of the commuter account at the entry transit readers;

FIG. 5A is a screenshot of an interface of the commuter mobile device wherein a commuter logs into the commuter account management system using the commuter account management application;

FIG. 5B is a screenshot illustrating links to funding sources that have been stored by the commuter within the commuter account;

FIG. 5C is a screenshot illustrating a top-up being made from a commuter account funding infrastructure for purposes of increasing the stored value of the commuter account;

FIG. 6 is a block diagram illustrating use by a commuter of the transit pass at the entry transit reader and an exit transit reader of the transit operator system, and routing of a charge request through a fare routing network to the commuter transaction service computer system, decrementing of the stored value, and potential blacklisting of the commuter account at all entry transit readers;

FIG. 7 is a block diagram illustrating interaction between a communications and automatic top-up module of the commuter transactions service computer system with a commuter mobile device;

FIG. 8A is a time chart illustrating how a stored value of the account changes due to actions by the commuter over time and communication with the commuter mobile device at various stages, followed by a voluntary increase of the stored value by the commuter;

FIG. 8B is a view similar to FIG. 8A illustrating the functioning of the communications and automatic top-up module if the commuter does not voluntarily increase the stored value;

FIG. 9 is a block diagram illustrating the overall process described in the preceding figures;

FIG. 10 is a block diagram of machine in the form of a computer system forming part of the transit billing network; and FIG. 11 is a block diagram of the commuter mobile device.

DETAILED DESCRIPTION OF THE INVENTION

FIG. 1 of the accompanying drawings illustrates a transit billing network 10 that includes a commuter transactions service computer system 12, a transit operator computer system 14, one transit pass 16 of many transit passes that are issued to commuters, a fare routing network 18, one commuter mobile device 20 of many commuter mobile devices, a commuter account funding infrastructure 22, the Internet 24, and a mobile phone interchange 26.

As shown in FIG. 3, the commuter transaction service commuter system 12 includes one commuter account 28 of a plurality of commuter accounts, a commuter admission control system 30, a commuter account activation module 32, a fare clearing system 34, and a commuter account management system 36.

Account Priming and Initial Blacklisting

The commuter account 28 is primed for activation and initially only includes a primary account number (PAN) 38 and transit pass code 40. By storing the PAN 38 and the transit pass code 40 in the same commuter account 28, the PAN 38 and the transit pass code 40 are associated with one another. The commuter accounts all have different PANs and different transit pass codes. A respective commuter account can thus be identified by either its PAN 38 or its respective transit pass code 40.

The commuter admission control system 30 includes an admission update module 42, a communication and automatic top-up module 44, a clock 46 connected to both the admission update module 42 and the communication and automatic top-up module 44, and a data exchange module 45. The admission update module 42 initially extracts all the PANs 38 from the respective commuter accounts 28. The admission update module 42 then creates a respective entry, wherein each entry includes a respective PAN, and marker indicating that the entry is blacklisted. The admission update module 42 then transmits the entries in a list over the Internet 24 to the transit operator system 14. The blacklisting of the entries indicates that the commuter accounts 28 have only been primed for activation and have not actually been activated. The entries can be indicated as follows:

| PAN | Status Marker |
|---|---|
| 4856 2003 3609 6358 | Blacklisted |
| 4856 2003 3609 6359 | Blacklisted |
| 4856 2003 3609 6360 | Blacklisted |

The transit operator system 14 includes one entry transit reader 48 of many entry transit readers, a respective entry transit gate 50 at and connected to each entry transit reader 48, one exit transit reader 52 of many exit transit readers, and a transit computer system 54. The entry transit reader 48 is located next to an entry lane towards a commuter platform such as an underground train platform, and the exit transit reader 52 is located next to an exit lane from such a platform. The entry transit gate 50 provides access through the entry lane and is controlled by the entry transit reader 48 to either provide access or deny access through the lane. The entry transit reader has a memory 56 and a transit pass reader 58 connected to the memory 56.

The transit computer system 54 includes an admission reception module 60, an admission list 62, an admission list refresh module 64, and a fare calculation module 66. The admission reception module 60 receives the list over the Internet or other network from the admission update module 42. The admission reception module 60 then stores the list as the admission list 62. The admission list refresh module 64 periodically, e.g. daily, pushes the admission list 62 into the memory 56 of the entry transit reader 48 and all other entry transit readers within the transit operator system 14. Because all the entries are initially blacklisted, the entry transit reader 48 will not permit the entry transit gate 50 to open after any transit pass is read by the transit pass reader 58.

The transit pass 16 includes a PAN 68, a transit pass code 70, and a short code 72. The transit pass 16 is issued by an operator of the commuter transactions service computer system 12. As such, the operator has matched the PAN 38 in the commuter account 28 and the PAN 68 of the transit pass 16. Each commuter account 28 thus has a respective PAN 38 that matches a respective PAN 68 of a respective transit pass 16. The PAN 68 may for example be stored in a magnetic strip, in which case the transit pass reader 58 of the entry transit reader 48 is a magnetic strip reader. Similarly, the exit transit reader 52 will then have a magnetic strip reader. Alternatively, the transit pass reader 58 may be a Near Field Communication (NFC) reader, in which case the PAN 68 will be stored within an NFC chip in the transit pass 16. The exit transit reader 52 will also then have an NFC reader to read the PAN 68.

The transit pass code 70 and the short code 72 are visible codes that can be read by a commuter. The transit pass code 70 matches the transit pass code 40 within the commuter account 28. Each transit pass 16 has a different transit pass code 70. The transit pass code 70 is the same as the transit pass code 40 that matches the PAN 38 in the respective commuter account 28. As such, the same relationship exists between the transit pass code 70 and PAN 68 as between the transit pass code 40 and the PAN 38.

Account Activation

Referring now to FIG. 3, the transit pass 16 has instructions printed thereon for activating the commuter account 28. According to the instructions, the commuter is asked to send a Short Message Service (SMS) message with the transit pass code 70 to the short code 72.

The commuter mobile device 20 includes an interface 74, an SMS module 76, a commuter account management application 78, and a phone number or a Mobile Subscriber Integrated Service Digital Network Number (MSISDN) 80. The commuter accesses the SMS module 76 and enters a short code 82 corresponding to the short code 72 on the transit pass 16 and a transit pass code 84 corresponding to the transit pass code 70 on the transit pass 16 into the interface 74. The commuter then uses the SMS module 76 to transmit an SMS 86 from the commuter mobile device 20. The SMS 86 includes a short code 88 corresponding to the short code 82 and a transit pass code 90 corresponding to the transit pass code 84. The SMS module 76 also extracts the MSISDN 80 and transmits a MSISDN 92 corresponding to the MSISDN 80 as part of the SMS 86.

The mobile phone interchange 26 receives the SMS 86 as an SMS 94 and utilizes the short code 88 to route the SMS 94 to the data exchange module 45. The data exchange module 45 is thus registered with the mobile phone interchange 26 with the address for the short code 88, in order to receive the SMS 94.

The data exchange module 45 receives the SMS 94 as an SMS 96 and extracts the transit pass code 90 and the MSISDN 92 from the SMS 96. The commuter account activation module 32 subsequently utilizes the transit pass code 90 to identify one of the commuter accounts 28 having the transit pass code 40 corresponding to the transit pass code 90. Once the respective commuter account 28 has been identified, the commuter account activation module 32 stores the respective MSISDN 92 as a MSISDN 98 in the respective commuter account 28. The MSISDN 98 is thus associated with the transit code 40 and the PAN 38 of the respective commuter account 28.

The commuter account activation module 32 also stores a password 100 in the commuter account 28 and therefore in association with MSISDN 98, the transit code 40 and the PAN 38. According to one embodiment, the commuter account activation module 32 may communicate with the commuter mobile device 20 so that a user enters a password 102 in the interface 74, whereafter the password 102 is transmitted by the SMS module 76 through the mobile phone interchange 26 and is then received by the data exchange module 46. The commuter account activation module 32 then stores the password 102 received by the data exchange module 45 as the password 100 in the commuter account 28.

Top-Up by Commuter

As illustrated in FIG. 4, the commuter account management application 78 allows for management of the commuter account 28 by communicating with the commuter account management system 36 over the Internet 24. The commuter account management system 36 includes a data exchange module 104, a login module 106, and a settings and payment system 108.

The commuter can enter a password 110 and a MSISDN 112 into the interface 74, which are respectively received as a password 114 and a MSISDN 116 within the commuter account management application 78. The data exchange module 104 receives the password 114 as a password 118 and the MSISDN 116 as a MSISDN 120. The login module 106 utilizes the MSISDN 120 to identify one of the commuter accounts 28 by its respective MSISDN 98. If a match exists between the MSISDN 120 and the MSISDN 98, the login module 106 also compares the password 118 with the password 100 of the respective commuter account 28 that has been identified. If a positive match exists between the password 118 and the password 100, the login module 106, at 122, authorizes access to the settings and payment system 108 to the commuter account management application 78 only with respect to the respective commuter account 28 that has been identified.

The commuter can use the interface 74 to enter a funding source 124, which is received as a funding source 126 within the commuter account management application 78. The data exchange module 104 receives the funding source 126 as a funding source 128. The settings and payment system 108 includes a funding source storing module 130 that stores the funding source 128 as a funding source 132 within the respective commuter account 28 having the appropriate MSISDN 98.

The commuter account 28 also has a stored value 134 that is initially set to zero. Should the commuter wish to increase the stored value 134, the commuter enters a credit value 136, for example $40, within the interface 74. The credit value 136 is received as a credit value 138 by the commuter account management application 78 and is transmitted over the Internet 24 to the data exchange module 104. The data exchange module 104 receives the credit value 138 as a credit value 140. The settings and payment system 108 further includes a funding module 142 that receives the credit value 140. At 144, the funding module 142 retrieves the funding source 132 and the MSISDN 98 from the commuter account 28. At 146, the funding module 142 communicates with the commuter account funding infrastructure 22 by transmitting a funding request. The commuter account funding infrastructure 22 may for example include a bank account number. The funding module 142 thus uses the routing information of the funding source 132 to reach the respective bank account number in the commuter account funding infrastructure 22. At 146, the respective credit value 140, in the present example $40, is also transmitted to the commuter account funding infrastructure 22. The signal transmitted at 146 also includes an IP address of the commuter transactions service computer system 12, for purposes of return communication.

The commuter account funding infrastructure 22 then makes a determination whether sufficient funds are available within the commuter account funding infrastructure 22 to allow for the transfer of the credit value 140. At 148, the commuter account funding infrastructure 22 utilizes the IP address received at 146 to transmit a top-up confirmation to the funding module 142. A top-up confirmation is only transmitted if sufficient funds are available within the commuter account funding infrastructure 22 to cover the credit value 140.

If insufficient funds are available within the commuter account funding infrastructure 22, then no top-up confirmation will be transmitted at 148 and a decline signal will instead be transmitted to the funding module 142. If a decline signal is received by the funding module 142 from the commuter account funding infrastructure 22, the funding module 142 updates the interface 74 to indicate that the stored value 134 will not be increased.

If the top-up confirmation transmitted at 148 is received by the funding module 142, the funding module 142 then provides the MSISDN 98 received at 144 and the credit value 140 to an account lookup and credit module 150 forming part of the settings and payment system 108. The account lookup and credit module 150 then, at 152, utilizes the MSISDN 98 to access the respective commuter account 28 and increases the stored value 134 by the credit value 140. In the present example, the stored value 134 is thus increased from zero dollars to $40.

FIG. 5A shows the interface 74 when the commuter enters the password 110 and the MSISDN 112. FIG. 5B illustrates the interface 74 after the commuter has entered the funding source 124 and the funding source 124 has been saved as the funding source 132 and the funding source 132 is then displayed within the interface 74. FIG. 5C illustrates the interface 74 when the user enters the credit value 140 for purposes of increasing the stored value 134.

The commuter account management application 78 thus provides one convenient manner for the commuter to increase the stored value 134. Alternatively, the commuter may pay a credit value at a kiosk and a signal is transmitted from the kiosk to the funding module 142 indicating that the stored value 134 should be increased. The commuter may also contact their bank to send a similar signal.

Unblacklisting

Referring again to FIG. 4, following replenishment of the stored value 134 by the account lookup and credit module 150, the account lookup and credit module 150 communicates with the admission update module 42 to indicate that the stored value 134 has been replenished. The admission update module 42 then checks whether the stored value 134 is above a predetermined amount. If the admission update module 42 determines that the stored value 134 is above a predetermined amount, the admission update module 42 transmits an entry that includes the PAN 38 and an indication that the respective PAN has been unblacklisted to the admission reception module 60. The admission reception module 60 then updates the admission list 62 with the unblacklisting entry. The admission list refresh module 64 then updates the unblacklisted entry in the memory 56 of the entry transit reader 48 and all other transit readers within the transit operator system 14.

Referring to FIG. 6, should a commuter with the transit pass 16 with the PAN 68 matching the PAN 38 of the respective commuter account 28 that has been unblacklisted within the memory 56 scan the transit pass 16 within the transit pass reader 58, the entry transit reader 48 will unlock or open the entry transit gate 50 to allow the commuter to pass therethrough.

Transit Fare Billing

The commuter then travels from a location where the entry transit reader 48 is located to a location where the exit transit reader 52 is located. Before leaving the transit operator system 14, the transit pass is again read, this time by the exit transit reader 52. The fare calculation module 66 is connected remotely to both the entry transit reader 48 and the exit transit reader 52 and calculates a fare amount from a table based on a distance travelled from the entry transit reader 48 and the exit transit reader 52. The fare calculation module 66, at 160, transmits a charge request to the fare routing network 18. The charge request includes the PAN 68 of the respective transit pass 16 and the fare amount calculated by the fare calculation module 66.

The fare routing network 18 includes a merchant acquirer computer system 162 and a credit card computer system 164. The merchant acquirer computer system 162 receives the charge request transmitted at 160. The PAN 68 includes an Issuer Identification Number (IIN) 166 and an Individual Account Identifier (IAI) 168. The first digit of the IIN 166 is a Major Industry Identifier (MII) 170. The merchant acquirer computer system 162 utilizes the IIN 166 to route the charge request received at 160 as a charge request 172 to the appropriate credit card computer system 164. The credit card computer system 164 then uses the IIN 166 to route the charge request received at 172 to the appropriate fare clearing system 34 at 174.

The fare clearing system 34 includes a fare routing gateway 176 and an account lookup and debit module 178. The fare routing gateway 176 receives the charge request transmitted at 174 and, at 180, provides a packet including the PAN 68 and the fare amount to the account lookup and debit module 178. At 182, the account lookup and debit module 178 utilizes the PAN 68 received from the fare routing gateway 176 to identify the respective commuter account 28 with the PAN 38 that is the same. At 182, the account lookup and debit module 178 reduces the stored value 134 of the respective commuter account 28 by the fare amount. In this manner, the fare amount is billed to the respective commuter account 28.

Re-Blacklisting

The account lookup and debit module 178 notifies the admission update module 42 that the stored value 134 has been reduced. The admission update module 42 responds to the notification from the account lookup and debit module 178 to again check whether the stored value 134 is above or below the predetermined amount. If the stored value 134 has fallen below the predetermined amount, the admission update module 42 transmits an entry to the admission reception module 60 with the respective PAN 38 of the respective commuter account 28 and an indication that the respective entry has been blacklisted. If the stored value 134 has remained above the predetermined amount, the admission update module 42 will not transmit the respective PAN 38 as blacklisted to the admission reception module 60.

Blacklisting-Based Commuter Communication and Automatic Top-Up

Reference is now made to FIG. 7 to illustrate the functioning of the communication and automatic top-up module 44. At 184, the admission update module 42 notifies the communication and automatic top-up module 44 if a blacklisting entry has been transmitted for the respective commuter account 28. The communication and automatic top-up module 44 also checks the stored value 134 to determine by how much the stored value 134 has to be topped-up, which is the difference between the minimum amount and the stored value 134. The communication and automatic top-up module 44 then utilizes the MSISDN 98 for a series of communications over the mobile phone interchange 26 with the commuter mobile device 20.

In the embodiment that is described the stored value is increased using Multiple premium Messages and an account system of a mobile phone carrier. In another embodiment an alternate form of automatic replenishment of the stored value can be used such as Direct Billing or another Mobile Billing method.

The communication and automatic top-up module 44 first transmits a warning message that is received as the warning message 190 within the SMS module 76 and then displayed as a warning message 192 within the interface 74. The warning message 192 is typically displayed within the interface 74 within five minutes after the respective commuter account 28 has been blacklisted. The warning message 192 is an SMS message that may read "Warning: your stored value within your commuter account needs to be replenished by $5 and will be automatically replenished within 24 hours using Multiple Premium Messages."

The commuter then has an option to replenish the stored value 134 as hereinbefore described by using the commuter account management application 78. In another embodiment, the stored value 134 may be replenished using an SMS feedback system.

Should the stored value 134 not be replenished within a predetermined time, in the present example 24 hours, the communication and automatic top-up module 44 calculates a number of Multiple Premium Messages and transmits the Multiple Premium Messages over the mobile phone interchange 26 and which are received as Multiple Premium Messages 194 within the SMS module 76. The Multiple Premium Messages 194 are then displayed as Multiple Premium Messages 196 within the interface 74. The Multiple Premium Messages 196 are then billed by the mobile phone interchange 26 to an account (not shown) of the commuter at the mobile phone interchange 26. In a later settlement, a portion of the funds billed to the account within the mobile phone interchange 26 is transferred to an operator of the commuter transactions service computer system 12.

Timing

FIG. 8A illustrates the functioning of the transit billing network as hereinbefore described according to one scenario. At time T1 the commuter purchases the transit pass 16. At T2, the commuter activates the commuter account 28. At T3, the commuter adds an amount, in the present example $5, to the stored value 134 of the commuter account 28, and an SMS is transmitted by the commuter admission control system 30 to the commuter mobile device 20 stating that there is $5 left in the stored value 134 of the commuter account 28.

At T4, the commuter uses the commuter account 28 to pay for a purchase, for example a purchase at a store. An SMS message is transmitted to the commuter mobile device 20 stating that there is $2 left in the stored value 134 of the commuter account 28.

At T5, the commuter enters the transit network, has the transit pass read by the entry transit reader 48 and begins to travel. At T6, the transit operator system 14 transmits a payment request to the commuter admission control system 30. The payment request may for example be for a fare of $4. Because the stored value 134 of the commuter account 28 is less than $4, the commuter admission control system 30 returns a refuse signal to the transit operator system 14 and blacklists the commuter account 28 at T7. The remaining $2 in the stored value 134 is then deducted to bring the balance to zero dollars.

At T8, the commuter exits the transit operator system 14 and an actual fare of $6 is calculated. Shortly following T8, an SMS is transmitted from the commuter admission control system 30 to the commuter mobile device 20 with a warning message 190.

In the present example it is assumed that at T9, the commuter adds $7 to the stored value 134, thus bringing the balance to $7. At T10, the commuter admission control system 30 reduces the balance by $4, corresponding to the difference between the actual fare of $6 and the $2 that was obtained from the stored value 134.

FIG. 8B illustrates a scenario where the commuter does not add the $7 at T9 and the $4 charge is not applied at T10. At T11, the Multiple Premium Messages 194 are transmitted to the commuter mobile device 20. The total number of Multiple Premium Messages 194 and their value add up to a total amount of $10, corresponding to a minimum balance of $6 and the additional $4 that was owed after T8. At T12, the $4 is reduced from the stored value 134, to bring the stored value 134 to the minimum balance of $6.

Overall Process

FIG. 9 illustrates the overall processes hereinbefore described. At 200, all the accounts are initially blacklisted as described with reference to FIG. 2. At 202 and 204, an account is activated and at 206, the account is unblacklisted as described with reference to FIG. 3. At 208 and 210, the commuter voluntarily tops-up the stored value balance as described with reference to FIG. 4. At 212 and 214, the commuter uses the transit pass 16 and a corresponding charge is incurred as describe with reference to FIG. 6 and at 216, the account is blacklisted as described with reference to FIG. 6. At 218, the SMS warning message is transmitted to the commuter mobile device 20 and, at 220, the Multiple Premium Messages are transmitted to the commuter mobile device 20, as described with to reference to FIG. 7.

From the foregoing description, it can be seen that control is exercised over commuter payment. The commuter account is initially blacklisted. The commuter is then asked to activate the account and to increase the stored value of the account before the account can be unblacklisted. The commuter is then allowed to use the transit system with possible blacklisting. During activation, the commuter provides the MSISDN, which is then used to communicate with the commuter mobile device while the commuter account remains blacklisted. The MSISDN and the commuter account thus create a relationship with the commuter. In the embodiment described, Multiple Premium Messages can subsequently be transmitted to the commuter mobile device, for purposes of collection of funds and replenishment of the stored value.

Computer System

FIG. 10 shows a diagrammatic representation of a machine in the exemplary form of a computer system 900 within which a set of instructions, for causing the machine to perform any one or more of the methodologies discussed herein, may be executed. In alternative embodiments, the machine operates as a standalone device or may be connected (e.g., networked) to other machines. In a network deployment, the machine may operate in the capacity of a server or a client machine in a server-client network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 900 includes a processor 930 (e.g., a central processing unit (CPU), a graphics processing unit (GPU), or both), a main memory 932 (e.g., read-only memory (ROM), flash memory, dynamic random access memory (DRAM) such as synchronous DRAM (SDRAM) or Rambus DRAM (RDRAM), etc.), and a static memory 934 (e.g., flash memory, static random access memory (SRAM, etc.), which communicate with each other via a bus 136.

The computer system 900 may further include a video display 938 (e.g., a liquid crystal display (LCD) or a cathode ray tube (CRT)). The computer system 900 also includes an alpha-numeric input device 940 (e.g., a keyboard), a cursor control device 942 (e.g., a mouse), a disk drive unit 944, a signal generation device 946 (e.g., a speaker), and a network interface device 948.

The disk drive unit 944 includes a machine-readable medium 950 on which is stored one or more sets of instructions 952 (e.g., software) embodying any one or more of the methodologies or functions described herein. The software may also reside, completely or at least partially, within the main memory 932 and/or within the processor 930 during execution thereof by the computer system 900, the memory 932 and the processor 930 also constituting machine readable media. The software may further be transmitted or received over a network 954 via the network interface device 948.

While the instructions 952 are shown in an exemplary embodiment to be on a single medium, the term "machine-readable medium" should be taken to understand a single medium or multiple media (e.g., a centralized or distributed database or data source and/or associated caches and servers)

that store the one or more sets of instructions. The term "machine-readable medium" shall also be taken to include any medium that is capable of storing, encoding, or carrying a set of instructions for execution by the machine and that cause the machine to perform any one or more of the methodologies of the present invention. The term "machine-readable medium" shall accordingly be taken to include, but not be limited to, solid-state memories and optical and magnetic media.

SmartPhone

FIG. 11 is a block diagram illustrating the commuter mobile device 24, illustrating a touch-sensitive display 1120 or a "touch screen" for convenience. The commuter mobile device 30 includes a memory 1020 (which may include one or more computer readable storage mediums), a memory controller 1220, one or more processing units (CPU's) 1200, a peripherals interface 1180, RF circuitry 1080, audio circuitry 1100, a speaker 1110, a microphone 1130, an input/output (I/O) subsystem 1060, other input or control devices 1160 and an external port 1240. These components communicate over one or more communication buses or signal lines 1030.

The various components shown in FIG. 11 may be implemented in hardware, software or a combination of both hardware and software, including one or more signal processing and/or application specific integrated circuits.

The memory 1020 may include high-speed random access memory and may also include non-volatile memory, such as one or more magnetic disk storage devices, flash memory devices, or other non-volatile solid-state memory devices. Access to the memory 1020 by other components of the commuter mobile device 30, such as the CPU 1200 and the peripherals interface 1180, is controlled by the memory controller 1220.

The peripherals interface 1180 connects the input and output peripherals of the device to the CPU 1200 and memory 1020. The one or more processors 1200 run or execute various software programs and/or sets of instructions stored in the memory 1020 to perform various functions for the commuter mobile device 30 and to process data.

The RF (radio frequency) circuitry 1080 receives and sends RF signals, also called electromagnetic signals. The RF circuitry 1080 converts electrical signals to/from electromagnetic signals and communicates with communications networks and other communications devices via the electromagnetic signals. The RF circuitry 1080 includes well-known circuitry for performing these functions, including an antenna system, an RF transceiver, one or more amplifiers, a tuner, one or more oscillators, a digital signal processor, a CODEC chipset, a subscriber identity module (SIM) card, memory, and so forth. The RF circuitry 1080 may communicate with networks, such as the Internet, also referred to as the World Wide Web (WWW), an intranet and/or a wireless network, such as a cellular telephone network, a wireless local area network (LAN) and/or a metropolitan area network (MAN), and other devices by wireless communication. The wireless communication may use any of a plurality of communications standards, protocols and technologies that are known in the art.

The audio circuitry 1100, the speaker 1110, and the microphone 1130 provide an audio interface between a user and the commuter mobile device 30. The audio circuitry 1100 receives audio data from the peripherals interface 1180, converts the audio data to an electrical signal, and transmits the electrical signal to the speaker 1110. The speaker 1110 converts the electrical signal to human-audible sound waves. The audio circuitry 1100 also receives electrical signals converted by the microphone 1130 from sound waves. The audio circuitry 1100 converts the electrical signal to audio data and transmits the audio data to the peripherals interface 1180 for processing. The audio circuitry 1100 also includes a headset jack serving as an interface between the audio circuitry 1100 and removable audio input/output peripherals, such as output-only headphones or a headset with both output (e.g., a headphone for one or both ears) and input (e.g., a microphone).

The I/O subsystem 1060 connects input/output peripherals on the commuter mobile device 30, such as the touch screen 1120 and other input/control devices 1160, to the peripherals interface 1180. The I/O subsystem 1060 includes a display controller 1560 and one or more input controllers 1600 for other input or control devices. The one or more input controllers 1600 receive/send electrical signals from/to other input or control devices 1160. The other input/control devices 1160 may include physical buttons (e.g., push buttons, rocker buttons, etc.), dials, slider switches, joysticks, click wheels, and so forth all serving as forming part of an interface. The input controllers 1600 may be connected to any of the following: a keyboard, infrared port, USB port, and a pointer device such as a mouse. The one or more buttons may include an up/down button for volume control of the speaker 1110 and/or the microphone 1130. The one or more buttons may include a push button. A quick press of the push button may disengage a lock of the touch screen 1120 or begin a process that uses gestures on the touch screen to unlock the device. A longer press of the push button may turn power to the commuter mobile device 30 on or off. The touch screen 1120 is used to implement virtual or soft buttons and one or more soft keyboards.

The touch-sensitive touch screen 1120 provides an input interface and an output interface between the device and a user. The display controller 1560 receives and/or sends electrical signals from/to the touch screen 1120. The touch screen 1120 displays visual output to the user. The visual output may include graphics, text, icons, video, and any combination thereof (collectively termed "graphics"). In some embodiments, some or all of the visual output may correspond to user-interface objects, further details of which are described below.

A touch screen 1120 has a touch-sensitive surface, sensor or set of sensors that accepts input from the user based on haptic and/or tactile contact. The touch screen 1120 and the display controller 1560 (along with any associated modules and/or sets of instructions in memory 1020) detect contact (and any movement or breaking of the contact) on the touch screen 1120 and converts the detected contact into interaction with user-interface objects (e.g., one or more soft keys, icons, web pages or images) that are displayed on the touch screen. In an exemplary embodiment, a point of contact between a touch screen 1120 and the user corresponds to a finger of the user.

The touch screen 1120 may use LCD (liquid crystal display) technology, or LPD (light emitting polymer display) technology, although other display technologies may be used in other embodiments. The touch screen 1120 and the display controller 1560 may detect contact and any movement or breaking thereof using any of a plurality of touch sensing technologies now known or later developed, including but not limited to capacitive, resistive, infrared, and surface acoustic wave technologies, as well as other proximity sensor arrays or other elements for determining one or more points of contact with a touch screen 1120.

The user may make contact with the touch screen 1120 using any suitable object or appendage, such as a stylus, a finger, and so forth. In some embodiments, the user interface is designed to work primarily with finger-based contacts and gestures, which are much less precise than stylus-based input due to the larger area of contact of a finger on the touch screen. In some embodiments, the device translates the rough finger-based input into a precise pointer/cursor position or command for performing the actions desired by the user.

The commuter mobile device 30 also includes a power system 1620 for powering the various components. The power system 1620 may include a power management system, one or more power sources (e.g., battery, alternating current (AC)), a recharging system, a power failure detection circuit, a power converter or inverter, a power status indicator (e.g., a light-emitting diode (LED)) and any other components associated with the generation, management and distribution of power in portable devices.

The software components stored in memory 1020 include an operating system 1260, a communication module (or set of instructions) 1280, a contact/motion module (or set of instructions) 1300, a graphics module (or set of instructions) 1320, a text input module (or set of instructions) 1340, and applications (or set of instructions) 1360.

The operating system 1260 (e.g., Darwin, RTXC, LINUX, UNIX, OS X, WINDOWS, or an embedded operating system such as VxWorks) includes various software components and/or drivers for controlling and managing general system tasks (e.g., memory management, storage device control, power management, etc.) and facilitates communication between various hardware and software components.

The communication module 1280 facilitates communication with other devices over one or more external ports 1240 and also includes various software components for handling data received by the RF circuitry 1080 and/or the external port 1240. The external port 1240 (e.g., Universal Serial Bus (USB), FIREWIRE, etc.) is adapted for coupling directly to other devices or indirectly over a network (e.g., the Internet, wireless LAN, etc.).

The contact/motion module 1300 may detect contact with the touch screen 1120 (in conjunction with the display controller 1560) and other touch sensitive devices (e.g., a touchpad or physical click wheel). The contact/motion module 1300 includes various software components for performing various operations related to detection of contact, such as determining if contact has occurred, determining if there is movement of the contact and tracking the movement across the touch screen 1120, and determining if the contact has been broken (i.e., if the contact has ceased). Determining movement of the point of contact may include determining speed (magnitude), velocity (magnitude and direction), and/or an acceleration (a change in magnitude and/or direction) of the point of contact. These operations may be applied to single contacts (e.g., one finger contacts) or to multiple simultaneous contacts (e.g., "multitouch"/multiple finger contacts). The contact/motion module 1300 and the display controller 1560 also detects contact on a touchpad.

The graphics module 1320 includes various known software components for rendering and displaying graphics on the touch screen 1120, including components for changing the intensity of graphics that are displayed. As used herein, the term "graphics" includes any object that can be displayed to a user, including text, web pages, icons (such as user-interface objects including soft keys), digital images, videos, animations and the like.

The text input module 1340, which may be a component of graphics module 1320, provides soft keyboards for entering text in various applications (e.g., contacts, e-mail, IM, blogging, browser, and any other application that needs text input). The applications 1360 may include the mobile application 208 such as the commuter account management application 78.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art. For example, reference is made to various technologies of a transit billing system that may find application to other billing systems. For certain aspects of the invention, reference to a "commuter," "commuter account," "fare amount" and "transit pass code" can be replaced with "consumer," "consumer account," "amount" and "pass code" respectively, although this may not apply to all aspects of the invention.

What is claimed:

1. A computer system for managing electronic transactions, comprising:

a server computer system including:

a processor;

a computer-readable medium connected to the processor;

a network interface device connected to the processor; and a set of instructions on the computer-readable medium, the set of instructions being executable by the processor and including:

a data store;

a plurality of consumer accounts stored in the data store, each consumer account having a first pass code, wherein each consumer account includes a respective first consumer account identifier, at least some of the accounts being blacklisted;

an issuer that issues each first pass code together with each first consumer account identifier of a respective consumer account and a short code, the first pass code and the short code being issued in a visible manner for a respective user to enter a respective first pass code as a respective second pass code in a respective SMS message and send the message to the short code before the respective account having the respective first pass code is unblacklisted and before a first phone number for the respective consumer account has been received;

a data exchange module receiving the SMS message including the second pass code and the first phone number;

a consumer account activation module identifying a selected one of the consumer accounts by matching the second pass code with a selected one of the first pass codes, the selected consumer account, before receiving the message, including the respective first consumer account identifier and being blacklisted, unblacklisting the selected consumer account, the unblacklisting being due to the matching of the second pass code with the first pass code and the receiving of the first phone number, and storing the first phone number as a second phone number in association with the selected first pass code of the selected consumer account;

a communication and routing module that, after the user enters the first consumer account identifier as a second consumer account identifier, receives a charge request over the network interface device, the charge request including an amount and the the second consumer account identifier, and identifying a selected one of the consumer accounts by associating one of the first consumer account identifiers with the second consumer account identifier; and a transaction processing system that processes the charge request based on an account detail of the identified consumer account, the transaction processing system only processing the charge request due to the selected consumer account being unblacklisted.

2. The computer system of claim 1, wherein the first phone number is extracted from the SMS message.

3. The computer system of claim 1, wherein the set of instructions further includes:

a communication module transmitting a message to a mobile phone at the second phone number.

4. The computer system of claim 1, wherein the set of instructions further includes:

a stored value in the consumer account; and a funding module receiving a top-up instruction from a consumer account funding infrastructure, and increasing the stored value based on the top-up instruction.

5. The computer system of claim 4, wherein the funding module further transmits a funding request to the consumer account funding infrastructure, the funding request including a credit value, and the top-up instruction is a top-up confirmation received in response to the funding request.

6. The computer system of claim 5, wherein the stored value is increased by the credit value.

7. The computer system of claim 4, wherein the set of instructions further includes:

a funding source storing module storing a funding source in the consumer account, wherein the funding module routes the funding request based on the funding source.

8. The computer system of claim 7, wherein the instructions further comprise:

a login module receiving login information from a user computer system over the network interface device, access to the funding source storing module by the user computer system to store the funding source only being permitted upon successful login based on the login information, the login information including a third phone number that is matched with the second phone number.

9. The computer system of claim 4, wherein the transaction processing system includes:

an account lookup and debit module that reduces the stored value based on the amount.

10. The computer system of claim 9, wherein the transaction processing system includes:

a transaction validation module that compares the stored value with the amount, wherein the account lookup and debit module only reduces the stored value with the amount, wherein the stored value is (i) only reduced if the stored value is at least as much as the amount and (ii) not reduced if the stored value is less than the amount, and transmits a confirmation over the network interface device to (i) to accept the charge request only reduced if the stored value is at least as much as the amount and (ii) to deny the charge request if the stored value is less than the amount.

11. A computer-based method of managing electronic transactions, comprising:

storing, with a processor, a plurality of consumer accounts in a data store, each consumer account having a first pass code, wherein each consumer account includes a respective first consumer account identifier, at least some of the accounts being blacklisted;

issuing, with the processor, each first pass code together with each first consumer account identifier of a respective consumer account and a short code, the first pass code and the short code being issued in a visible manner for a respective user to enter a respective first pass code as a respective second pass code in a respective SMS message and send the message to the short code before the respective account having the respective first pass code is unblacklisted and before a first phone number for the respective consumer account has been received;

receiving, with the processor, the SMS message including the second pass code and the first phone number;

identifying, with the processor, a selected one of the consumer accounts by matching the second pass code with a selected one of the first pass codes, the selected consumer account, before receiving the message, including the respective first consumer account identifier and being blacklisted;

unblacklisting, with the processor, the selected consumer account, the unblacklisting being due to the matching of the second pass code with the first pass code and the receiving of the first phone number, and storing the first phone number as a second phone number in association with the selected first pass code of the selected consumer account;

storing, with the processor, the first phone number as a second phone number in association with the selected first pass code of the selected consumer account;

receiving, with the processor, a charge request over the network interface device, the charge request including an amount and a second consumer account identifier;

identifying, by the processor, a selected one of the consumer accounts by associating one of the first consumer account identifiers with the second consumer account identifier; and processing, with the processor, the charge request based on an account detail of the identified consumer account, the transaction processing system only processing the charge request due to the selected consumer account being unblacklisted.

12. The method of claim 11, wherein the first phone number is extracted from the SMS message.

13. The method of claim 11 further comprising:

transmitting, with the processor, a message to a mobile phone at the second phone number.

14. The method of claim 11, further comprising:

saving, with the processor, a stored value in the consumer account;

receiving, with the processor, a top-up instruction from a consumer account funding infrastructure; and increasing, with the processor, the stored value based on the top-up instruction.

15. The method of claim 14, further comprising:

transmitting, with the processor, a funding request to the consumer account funding infrastructure, the funding request including a credit value, wherein the top-up instruction is a top-up confirmation received in response to the funding request.

16. The method of claim 15, wherein the stored value is increased by the credit value.

17. The method of claim 14, further comprising:

storing, with the processor, a funding source in the consumer account; and transmitting, with the processor, the funding request, the funding request being routed based on the funding source.

18. The method of claim 14, further comprising:

receiving, with the processor, login information from a user computer system over the network interface device, the storing by the user computer system of the funding source only being permitted upon successful login based on the login information, the login information including a third phone number that is matched with the second phone number.

19. The method of claim 14, further comprising:

reducing, with the processor, the stored value based on the amount.

20. The method of claim 19, further comprising:

comparing, with the processor, the stored value with the amount, wherein the stored value is (i) only reduced if the stored value is at least as much as the amount and (ii) not reduced if the stored value is less than the amount; and transmitting, with the processor, a confirmation over the network interface device to (i) to accept the charge request only reduced if the stored value is at least as much as the amount and (ii) to deny the charge request if the stored value is less than the amount.

* * * * *